US008025740B2

(12) United States Patent
Juergens et al.

(10) Patent No.: US 8,025,740 B2
(45) Date of Patent: Sep. 27, 2011

(54) PROCESS FOR CONDUCTING CLEANING OPERATIONS IN A FLUID-RECEIVING DEVICE OF A FOODSTUFF-PROCESSING APPARATUS, AND FLUID-RECEIVING DEVICE AND FOODSTUFF-PROCESSING APPARATUS THEREFOR

(75) Inventors: Andrea Juergens, Kirchheim (DE); Gerhard Kramer, Penzig/Untermühlhausen (DE); Judith Kling, Landsberg (DE); Tobias Gayer, Munich (DE); Wolfgang Holzapfel, Munich (DE); Bruno Maas, Wertach (DE); Erwin Schuller, Wolfratshausen (DE); Kerstin Geiger, Landsberg (DE); Peter Wiedemann, Klosterlechfeld (DE); Manfred Breunig, Schongau (DE)

(73) Assignee: Rational AG, Landsberg/Lech (DE)

( * ) Notice: Subject to any disclaimer, the term of this patent is extended or adjusted under 35 U.S.C. 154(b) by 429 days.

(21) Appl. No.: 12/162,713

(22) PCT Filed: Jan. 30, 2007

(86) PCT No.: PCT/DE2007/000182

§ 371 (c)(1),
(2), (4) Date: Dec. 17, 2008

(87) PCT Pub. No.: WO2007/085247

PCT Pub. Date: Aug. 2, 2007

(65) Prior Publication Data

US 2010/0064905 A1 Mar. 18, 2010

(30) Foreign Application Priority Data

Jan. 30, 2006 (DE) ..... 10 2006 004 340
Apr. 10, 2006 (DE) ..... 10 2006 016 757

(51) Int. Cl.
*B08B 9/08* (2006.01)
*B08B 3/00* (2006.01)

(52) U.S. Cl. ..... 134/22.18; 134/22.1; 134/36

(58) Field of Classification Search ..... 134/18, 134/22.18, 36, 100.1, 113, 167 R; 126/377.1; 122/14.1, 446, 447, 460; 236/20 R, 21 B, 236/26 R, 26 F
See application file for complete search history.

(56) References Cited

U.S. PATENT DOCUMENTS 5,640,946 A 6/1997 Oslin (Continued)

FOREIGN PATENT DOCUMENTS

DE 26 52 399 5/1978

(Continued)

OTHER PUBLICATIONS

International Search Report for International Application No. PCT/DE2007/000182, dated Oct. 10, 2007.

(Continued)

*Primary Examiner* — Michael Kornakov
*Assistant Examiner* — Nicole Blan
(74) *Attorney, Agent, or Firm* — Marshall, Gerstein & Borun LLP

(57) ABSTRACT

A process for conducting cleaning operations at predetermined time intervals in a chamber or container of a fluid-receiving device of a foodstuff-processing apparatus first comprises receiving a first fluid in the chamber or container. Then, first and second degrees of cleaning are determined at first and second moments in time, respectively. Then, a first difference between the first and second degrees of cleaning is determined. In a first case, in which the second degree of cleaning lies below a first limit value, the action duration of the at least one cleaning agent during at least one subsequent cleaning operation is set depending on the first degree of cleaning. In a second case, in which the second degree of cleaning lies above the first limit value, a greater amount of cleaning agent is supplied and/or the time interval between two subsequent, successive cleaning operations is shortened.

85 Claims, 5 Drawing Sheets

U.S. PATENT DOCUMENTS

| | | | | |
|---|---|---|---|---|
| 6,510,782 | B1 | 1/2003 | Blaschke et al. | |
| 6,513,462 | B1 * | 2/2003 | Shiraishi et al. | 122/382 |
| 2001/0011549 | A1 * | 8/2001 | Durth et al. | 134/22.18 |
| 2003/0145847 | A1 * | 8/2003 | Deuringer et al. | 126/377.1 |
| 2005/0072382 | A1 * | 4/2005 | Tippmann | 122/460 |

FOREIGN PATENT DOCUMENTS

| | | |
|---|---|---|
| DE | 40 29 511 | 3/1992 |
| DE | 199 12 444 | 9/2000 |
| DE | 100 28 595 | 1/2002 |
| DE | 102 59 829 | 7/2004 |
| DE | 20 2004 013 787 | 2/2005 |
| DE | 10 2004 009 191 | 9/2005 |
| EP | 1 162 402 | 12/2001 |
| EP | 1 430 823 | 6/2004 |
| JP | 10-9506 | 1/1998 |

OTHER PUBLICATIONS

Written Opinion for International Application No. PCT/DE2007/000182, dated Oct. 10, 2007.

International Preliminary Report on Patentability for International Application No. PCT/DE2007/000182, dated Sep. 9, 2008.

* cited by examiner

PROCESS FOR CONDUCTING CLEANING OPERATIONS IN A FLUID-RECEIVING DEVICE OF A FOODSTUFF-PROCESSING APPARATUS, AND FLUID-RECEIVING DEVICE AND FOODSTUFF-PROCESSING APPARATUS THEREFOR

FIELD OF THE INVENTION

The present invention concerns a method for conducting cleaning operations in a fluid-receiving device of a foodstuff-processing apparatus, a fluid receiving device for use in a process according to the invention and a foodstuff-processing apparatus, specifically a cooking apparatus, comprising a fluid-receiving device according to the invention.

BACKGROUND

Precautions for the avoidance or elimination of contaminations or deposits, such as scale deposits, dirt and/or corrosion are of importance, specifically in apparatuses for the heating and vaporization of a fluid, especially of water, as in the case of vapor generators, in order to ensure cost-effective operation and maximum lifetime of the apparatus.

A number of devices are known in the state of the art, which provide information on the state of scale forming in apparatuses for the heating and vaporization of water, so that when scale is detected, measures for descaling can be undertaken.

For example, a reliable and, due to its simplicity, cost-effective device is known from German patent DE 199 12 444 C2. In this device, the degree of scale forming vapor generator of a cooking apparatus is determined, by evaluating the difference between a filling volume of a heat generator in the scale-free state and a filling volume after a number of fillings of the steam generator with calcium-containing water. When the difference exceeds a pre-determined value, it is assumed that a reduction of the filling volume occurred due to scale forming, and that descaling of the vapor generator is to be performed. Although with this device it can be determined reliably if a certain degree of scale is present in the apparatus, the device does not make it possible to perform a defined conducting of a cleaning or descaling operation. In particular, no conclusions can be drawn about a suitable dosage of cleaning agents, descaling agents, or water-softening agents.

A household device with a sensor for the determination of the hardness of the water is known from DE 20 2004 013 787 U1. According to this disclosure, a dosage of a water-softening agent that is fed continuously into a fluid in order to prevent the formation of scale is effected as a function of the water hardness determined with the hardness sensor. Such a continuous softening of the water, however, cannot be used in a cooking appliance since the softening agent would have an adverse influence on the cooking result. In a fluid-receiving device of a cooking appliance, therefore, the cleaning processes, specifically descaling processes must be performed independently of the cooking operation.

DE 102 59 829 A1 discloses a method and a device for descaling in vapor generators for cooking appliances. The device comprises a storage container, which is connected to a vapor generator via a connecting line. Within the connecting line, a device is provided that makes it possible to introduce a certain amount of descaling agent into the vapor generator at a predetermined moment in time. Depending on the duration of operation and/or on a determined degree of scale in the vapor generator, the descaling agent is introduced into the vapor generator. However, the disadvantage of this method is that the descaling process in the vapor generator cannot be performed with the disclosed device in such a way that it is adjusted in the best possible way to the existing environmental conditions and optimized in the best possible way so that overdosage of the descaling agent and thus unnecessary pollution of the environment, insufficient descaling or unnecessarily long scaling processes and thus unnecessarily long interruptions in the operation are avoided.

GENERAL DESCRIPTION OF THE INVENTION

Therefore, an object of the present invention is to provide a method for carrying out cleaning operations in at least one container in a fluid-receiving device of a foodstuff processing apparatus that permits a best possible adaptation of the cleaning operators to the given environmental conditions and a best possible optimization of the cleaning operations with regard to duration in time and environmental compatibility. In addition, a fluid-receiving device for carrying out the method as well as a foodstuff-processing apparatus comprising such a fluid-receiving device is to be provided.

The object relating to the method is achieved by a method for conducting cleaning operations carried out at predetermined time intervals with respect to one another in at least one inner chamber and/or container of a fluid-receiving device of a foodstuff-processing apparatus, whereby in the inner chamber and/or container at least one first fluid can be accepted and at least a first degree of cleaning is determined at least one first moment in time of a first cleaning process, at least one second degree of cleaning of at least one subsequent second cleaning operation is determined at least one second moment in time and a first difference between the first degree of cleaning and the second degree of cleaning is determined, whereby in a first case, in which the second degree of cleaning lies below at least one first degree of cleaning limit value, the first difference lies at least below one first difference limit value and/or a cleaning speed lies below at least one first speed limit value, an exposure duration to at least one cleaning agent during at least one subsequent cleaning operation is determined and/or adjusted as a function of the first degree of cleaning, the second degree of cleaning, the first difference and/or the cleaning speed, and, in a second case, in which the second degree of cleaning lies above the first degree of cleaning limit value, the first difference lies about the first difference value and/or the cleaning speed lies above the first speed limit value, an increase of a dosage of the cleaning agent and/or a shortening of the time difference between two subsequent successive cleaning operations is effected.

It can, in particular, be provided that the beginning of the first cleaning operation is chosen as the first moment in time, the beginning of the second cleaning operation is chosen as the second moment in time, the end of the first cleaning operation is chosen as the first moment in time, and the end of the second cleaning operation is chosen as the second moment in time, the end of the first cleaning operation is chosen as the first moment in time and the beginning of the second cleaning operation is chosen as the second moment in time, or the beginning of the first cleaning operation is chosen as the first moment in time and the end of the second cleaning operation is chosen as the second moment in time.

In both of the above alternatives, it is proposed with the invention that the action time of the cleaning agent be determined as a function of the first degree of cleaning, the second degree of cleaning, the first difference and/or the speed of cleaning.

A method according to the invention can also be characterized by the fact that the speed of cleaning is determined by the time derivative of the degree of cleaning based on the first difference and the time difference between the first and second time points, specifically as the ratio of the first difference and the difference between the first and second time points.

In addition, it is proposed with the invention that in a third case, in which the speed of cleaning is positive, specifically the first degree of cleaning is smaller than the second degree of cleaning, the action time of the cleaning agent be extended for at least one subsequent cleaning operation by at least one first time period, and in a fourth case, in which the cleaning speed is negative, in particular the first degree of cleaning is larger than the second degree of cleaning, the action time of the cleaning agent is shortened for at least one subsequent cleaning operation by at least one second time period.

An especially advantageous alternative embodiment of this method provides that the first time period and/or the second time period is/are essentially predetermined and/or is/are determined as a function of, in particular, of the amount, the first difference and/or the cleaning speed, the first degree of cleaning and/or the second degree of cleaning.

It is especially preferred according to the invention that in a fifth case, in particular in the second case, in which furthermore the first and/or second degrees of cleaning lie below a second degree of cleaning limit value, the first difference lies below a second difference limit value and/or the cleaning speed lies below a second cleaning speed limit value, an increase of the dosage of the cleaning agent for at least one subsequent cleaning operation is effected, in particular as a function of the first degree of cleaning, the second degree of cleaning, the first difference and/or the cleaning speed, and in a sixth case, in particular the second case, in which the first and/or the second degree of cleaning lies above the second degree of cleaning limit value, the first difference lies above the second difference limit value and/or the cleaning speed lies above the second speed limit value, a shortening of the time interval between two subsequent successive cleaning operations is performed, in particular as a function of the first degree of cleaning, the second degree of cleaning, the first difference and/or the cleaning speed, and/or in a seventh case, in particular in the fifth or sixth case, in which the first and/or the second degree of cleaning a subsequent first and/or second cleaning operation again lies below the second degree of cleaning limit value, the first difference in subsequent first and second cleaning operations again lies below the second difference limit value and/or the cleaning speed again lies below the second speed limit value, a lengthening of the time interval between two subsequent successive cleaning operations is effected, in particular as a function of the first degree of cleaning, the second degree of cleaning, the first difference, and/or the second difference, and in an eighth case, in particular the fifth and/or sixth case in which the first and/or the second degree of cleaning of a subsequent first and/or second cleaning operation again lies below the first degree of cleaning limit value, the first difference in the subsequent first and second cleaning operation again lies below the first difference limit value and/or the cleaning speed again lies below the first speed limit value, a decrease of the dosage of the cleaning agent for subsequent cleaning operations is performed, specifically as a function of the first degree of cleaning, the second degree of cleaning, the first difference and/or of the cleaning speed.

Alternatively, or in addition, it can be provided that in a ninth case, in particular in the second case in which furthermore the first and/or the second degree of cleaning lies below a third degree of cleaning limit value, the first difference lies below a third difference limit value and/or the cleaning speed lies below a third cleaning speed difference value, a shortening of the time interval between two subsequent successive cleaning operations is effected, in particular as a function of the first degree of cleaning, the second degree of cleaning, the first difference and/or the cleaning speed, and in a tenth case, in particular in the second case in which the first and/or the second degree of cleaning lies above the third degree of cleaning limit value, the first difference lies above the third difference limit value and/or the cleaning speed lies above the third speed limit value, an increase of the dosage of the cleaning agent for at least one subsequent cleaning operation is effected, in particular as a function of the first degree of cleaning, the second degree of cleaning, the first difference and/or the cleaning speed, and/or in an eleventh case, in particular in the ninth and/or tenth case in which the first and/or the second degree of cleaning of a subsequent second cleaning operation again lies below the third degree of cleaning limit value, the first difference in the subsequent first and second cleaning operations again lies below the third difference limit value and/or the cleaning speed again lies below the third speed limit value, a decrease of the dosage of the cleaning agent for at least one subsequent cleaning operation is effected, in particular as a function of the first degree of cleaning, the second degree of cleaning, the first difference and/or the cleaning speed, and that in a twelfth case, in particular in the ninth and/or the tenth case in which the first and/or the second degree of cleaning of a subsequent first and/or second cleaning operation again lies below the first degree of cleaning limit value, the first difference in the subsequent first and second cleaning operations again lies below the first difference limit value and/or the cleaning speed again lies below the first speed limit value, a lengthening of the time interval between two subsequent successive cleaning operations is performed, in particular as a function of the first degree of cleaning, the second degree of cleaning, the first difference and/or the cleaning speed.

It is especially preferred that at the beginning of at least one third cleaning operation, in particular of the first or second cleaning operation, at least one third, in particular first or second degree of cleaning is determined, and that the end of the third cleaning operation at least one fourth degree of cleaning is determined, wherein the action time of the cleaning agent during the third cleaning operation is chosen in such a way that an essentially maximum cleaning is achieved for the selected dosage of the cleaning agent, and the first difference limit value based on at least one second difference between the third and fourth degree of cleaning is determined, in particular the first difference limit value is set essentially equal to the second difference.

Furthermore, the invention proposes that at the beginning of at least one fourth cleaning operation, in particular of the first or second cleaning operation, at least one fifth, in particular the first or second degree of cleaning is determined, and at the end of the fourth cleaning operation at least one sixth degree of cleaning is determined, wherein the action time of the cleaning agent during the fourth cleaning operation is chosen in such a way that essentially maximum cleaning is achieved for a maximum dosage of the cleaning agent, and the second difference limit value is determined based on at least one third difference between the fifth and sixth degree of cleaning, in particular the second difference limit value is set essentially equal to the third difference.

An especially advantageous embodiment of the invention provides that at the beginning of at least one fifth cleaning operation, in particular of the first or second cleaning operation, a seventh specifically the first or second degree of cleaning is determined and at the end of the fifth cleaning operation at least an eighth degree of cleaning is determined, whereby the action time of exposure of the cleaning agent during the fifth cleaning operation is selected so that for a minimum time interval between two cleaning operations and the selected dosage of the cleaning agent an essentially maximum cleaning is achieved and the third difference limit value based on at least one fourth difference between the seventh and the eight degree of cleaning is determined, in particular the third difference limit value is set essentially the same as the fourth difference.

Alternative embodiments of the invention can be characterized by the fact that at least one ninth degree of cleaning is determined at the end of a sixth, in particular of the first cleaning operation, at least one tenth degree of cleaning is determined at the beginning of at least one seventh cleaning operation following the sixth cleaning operation, in particular the second cleaning process, and at least one eleventh degree of cleaning at the end of the seventh cleaning operation is determined, wherein at least one fifth difference between the ninth and the tenth degree of cleaning and at least one sixth difference between the tenth and eleventh degree of cleaning are determined.

In this embodiment, it is proposed with the invention that at least one first interval duration is determined by the fact that the time interval between the sixth and the seventh cleaning process is multiplied with the sixth difference and divided by the fifth difference and/or the sixth difference is divided by the cleaning speed.

In both of the two aforementioned alternative embodiments, it is preferred that the distance in time between two subsequent successive cleaning operations, shortened by at least a second interval duration, be shortened to essentially the first interval duration, in particular in the sixth and/or ninth case, and/or the distance in time between two subsequent successive cleaning operations, lengthened by at least a third interval duration, be lengthened to essentially the first interval duration, in particular tin the seventh and/or the eight use.

Furthermore, the invention provides that the first time interval, the second time interval, the first interval duration, the second interval duration and/or the third interval duration is/are essentially predetermined and/or is/are determined as a function of, in particular the amount of the first difference, second difference, third difference, fourth difference, fifth difference, sixth difference, the first, second, third, fourth, fifth, sixth, seventh, eighth, ninth, tenth and/or eleventh degree of cleaning and/or of the cleaning speed.

The aforementioned embodiments of the invention can furthermore be characterized in that, based on the first, second and/or third interval duration, in particular as a function of the time that elapsed since a last cleaning operation, the expected moment in time of at least one subsequent cleaning operation is determined, in particular output, wherein the expected moment in time is preferably determined by subtraction of the elapsed time from the first interval duration.

Furthermore, it is proposed with the invention that the cleaning agent is comprised of at least one cleaning medium component, such as at least one rinsing agent, abrasive particles such as at least one granulate, specifically soluble in the first fluid, at least one agent for dissolving and/or removal of food residues, such as fats, carbohydrates, carbonates, sugars and/or proteins, at least one descaling agent and/or at least one detergent and/or active cleaning substance.

In the embodiment mentioned above, it is proposed with the invention that, in order to change the dosage of the cleaning agent, the concentration and/or the amount of the at least one cleaning component is altered, whereby the cleaning agent is preferably formed from two, preferably from a multiple different, in particular individually dispensable cleaning agent components.

The invention also provides that the dosage of the cleaning agent in at least one successive cleaning operation be altered by at least one adjustment value, whereby the adjustment value is determined, in particular based on a deviation from a target dosage of an actual dosage of the cleaning agent in at least one previously-performed cleaning operation.

It is preferable that the cleaning agent, specifically at least one cleaning agent component of the fluid-receiving device, be introduced at least partially manually, in particular as a function of at least one output dosage recommendation for the cleaning agent and/or for at least one cleaning component.

A further development of the invention provides that the second difference limit value be essentially equal to the third difference limit value, the second degree of cleaning limit value be essentially equal to the third degree of cleaning limit value and/or the second speed limit value be chosen equal to the third speed limit value, specifically in the fifth, sixth, ninth and/or the tenth case, as well as a shortening of the time interval between two cleaning operations as well as an increase of the dosage of the cleaning agent, as well as a lengthening of the time interval between two cleaning operations, as well as a reduction of the dosage of the cleaning agent, as well as a lengthening of the time interval between two cleaning operations as well as also an increase of the dosage of the cleaning agent and/or as well as a shortening of the second time interval between two cleaning operations as well as a reduction of the dosage of the cleaning agent are effected.

A further embodiment of the invention can be characterized in that the time interval between two cleaning operations, the first moment in time, the second moment in time, the first time interval, the second time interval, the time difference between the first and second moment in time, the first interval duration, the second interval duration, the third interval duration and/or the time elapsed since the last cleaning operation is determined based on, in particular in proportion to, at least one operating time of a foodstuff processing apparatus comprising the fluid-receiving device and/or of the fluid-receiving device.

The method according to the invention can be characterized in that the first cleaning limit value is chosen essentially equal to a minimum degree of cleaning, in particular that of an essentially completely cleaned fluid-receiving device, and/or the first difference limit value is chosen essentially equal to zero, in particular in each case an adjustment of both the action time and the dosage of the cleaning agent, both the action time and the time interval between two subsequent successive cleaning operations and/or an adjustment of the dosage of the cleaning agent and/or of the distance in time between subsequent successive cleaning operations is effected, in particular while maintaining a, preferably predetermined, action time of the cleaning agent, both the action time and the dosage of the cleaning agent as well as an adjustment of the action time and of the dosage of the cleaning agent as well as of the time distance in between two subsequent successive cleaning operations is effected.

According to the invention it is preferred that in a thirteenth case, in which the first and/or the second degree of cleaning lies below a fourth degree of cleaning limit value, the cleaning speed lies below a fourth speed limit value and/or the first difference lies below a fourth difference limit value, a cleaning agent is used which was used before and/or simultaneously for the cleaning of another component of the foodstuff-processing apparatus, in particular is recirculated through it, such as a cleaning solution, clear rinsing agent and/or descaling solution is used in a subsequent cleaning operation, and in a fourteenth case, in which the first and/or the second degree of cleaning lies above the fourth cleaning limit value, the first difference lies above the fourth cleaning limit value and/or the cleaning speed lies above the fourth speed limit value, a cleaning agent, which serves initially essentially exclusively to clean the fluid-receiving apparatus, such as a descaling agent and/or clear rinsing agent is used in a subsequent cleaning process.

It is also proposed with the invention that at least one degree of cleaning comprises at least one degree of soiling, at least one degree of contamination, at least one degree of scale forming and/or at least one degree of corrosion, at least one cleaning limit value comprises at least one soiling limit value, at least one contamination limit value, at least one scale forming value and/or at least one corrosion limit value, and/or at least one cleaning speed comprises at least one soiling speed, at least one contamination speed, at least one scale forming speed and at least one corrosion speed.

Furthermore, it is proposed with the invention that at least one degree of cleaning is determined by the determination of an inner volume change of the inner chamber and/or of the container of the fluid-receiving device, by determination of at least one temperature change rate of the first fluid in the inner chamber and/or in the container of the fluid-receiving device, by the determination of at least one surface temperature of at least one heating device of the fluid-receiving device and/or by determining at least one third and at least one fourth moment in time at which a fluid poured into the inner chamber and/or into the container comes into active contact with a first or a second sensor.

In particular, for determining a degree of cleaning, it is proposed with the invention for the method, that the method furthermore include the steps: determining at least one first level of the first fluid that can be introduced into the inner chamber and/or container, in the inner chamber and/or container after at least one filling of the inner chamber and/or container with a first predetermined amount of the first fluid and/or determining at least one second amount of the first fluid that is necessary in order to reach a second predetermined level of the first fluid in the inner chamber and/or container during the first filling, determining at least one third level of the first fluid in the inner chamber and/or container after at least one second filling of the inner chamber and/or container that is at least partially offset in time in comparison to the first filling, with a third predetermined amount of the first fluid and/or determining at least one fourth amount of the first fluid that is necessary in order to reach a fourth predetermined level of the first fluid in the inner chamber and/or container during the second filling, determining at least one change of at least two levels of the first fluid between the first and second filling, at least one second change of at least two amounts of the first fluid that are necessary for reaching at least one predetermined level of the first fluid in the inner chamber and/or container, between the first and second filling, and/or at least one third change of at least one first ratio formed from at least one level of the first fluid and at least one amount of the first fluid necessary for reaching a predetermined level, and at least of a second ratio formed from at least one other level and at least one other amount of the first fluid necessary to reach a predetermined level.

Herein it is preferred that at least one degree of cleaning of at least one cleaning speed and/or at least one characteristic quantity of the first fluid be determined using the first change, the second change and/or the third change.

In the two aforementioned alternatives, it is proposed with the invention that in order to determine the degree of cleaning, the cleaning speed and/or the characteristic quantity, the first change, the second change and/or the third change be compared with at least one comparison value.

The aforementioned embodiments may also provide that the first change be determined by determining of a seventh difference between the first and third level of the first fluid, wherein preferably the first amount and the third amount of the first fluid are essentially equal, the second change is determined by determining an eighth difference between the second and fourth amounts of the first fluid, wherein preferably the second level and the fourth level of the first fluid are essentially the same, and/or the first relation is formed from the first level and the second amount of the first fluid and/or the second relation is formed from the third level and the fourth amount of the first fluid, preferably a quotient from the first level and second amount of the first fluid and/or a quotient from the third level and the fourth amount of the first fluid, wherein, in particular, the first amount and the third amount of the first fluid and/or the second level and the fourth level of the first fluid are essentially equal.

Furthermore, it is proposed with the invention that the characteristic quantity of the first fluid based on the first, second, third, fourth, fifth, sixth, seventh, eighth, ninth, tenth and/or eleventh degree of cleaning and/or at least one further degree of deposition of at least one substance, preferably present in the first fluid, in particular dissolved in it, is determined at least one wall of the inner chamber and/or container is determined.

Preferred embodiments of the invention provide that at least one concentration of at least one second substance in the first fluid be determined as characteristic quantity, in particular, at least one concentration of ions present in the first fluid, in particular, dissolved in the first fluid, preferably of at least one alkaline-earth metal, such as calcium, magnesium, strontium, barium and/or compounds comprising two of these alkaline-earth metals, in particular, lime scale, wherein the second substance leads specifically to the deposit of the first substance and/or to the formation of a contamination, such as a lime scale, soiling and/or corrosion, the second substance is preferably at least partially identical with the first substance and/or that at least one degree of hardness of the first fluid be determined.

A further development of the method according to the invention can be characterized in that, depending on the characteristic quantity of the first fluid, at least one dosage recommendation is made for at least one third substance to be combined with the first fluid, specifically the dosage recommendation for the cleaning agent and/or at least one cleaning agent component is determined, and/or the dosage of the cleaning agent and/or at least one cleaning agent component is effected based on the characteristic quantity of the first fluid is effected.

Furthermore, the invention provides that the third substance, the cleaning agent and/or the cleaning agent component be mixed with the first fluid, preferably by means of at least one dosage device, in particular, the first fluid, and/or that at least one instruction is output to at least one user for the introduction of the third substance, the cleaning agent and/or at lest one cleaning agent component, in particular into the inner chamber and/or container.

An alternative or complementary embodiment of the method according to the invention provides that the third substance, the cleaning agent and/or at least one cleaning agent component be combined, in particular at least partly automatically, as a function of the determined distance between the cleaning operations, with the first fluid that can be introduced specifically to at least one element of a foodstuff-processing apparatus and/or fluid-receiving device that is in working connection with the fluid-receiving device, preferably the inner chamber and/or container at least of a vapor generator, at least one quenching box and/or at lest one cooking chamber, for the performance of cleaning operation in the fluid-receiving device.

Furthermore, the invention proposes that, as a third substance, as cleaning agent, and/or as cleaning agent component, at least one second fluid, preferably a second liquid and/or at least one soluble solid, preferably in the form of at least one tablet, be combined with the first fluid, preferably with the aid of the dosage device and/or by a user, in particular that the third substance is dissolved in the first fluid, in particular in the first liquid.

The method according to the invention can also be characterized in that with the aid of the third substance, the cleaning agent and/or a cleaning agent component, a change in the concentration of the second substance in the first fluid, in particular a cleaning, is achieved and/or by means of the third substance of the cleaning agent and/or a cleaning agent component at least one detergent substance, preferably a detergent and/or a clear rinsing agent, is formed.

A method according to the invention can also be characterized in that at least one alarm is produced when the level of a fluid, in particular comprising the first fluid, exceeds a predetermined value in the inner chamber and/or container.

In particular for the determination of a degree of cleaning, the invention proposes that the method furthermore comprise the following steps:

a. Determining a third moment in time, at which a fluid commences interaction with at least one first, contactless sensor outside on a wall of the inner chamber and/or container, or outside on an inlet to the inner chamber and/or container, through a change of a first output signal of the at least one first sensor;
b. Determining a fourth moment in time, at which the fluid commences interaction with at least one second contactless sensor arranged outside on a wall of the inner chamber and/or container, through a change of a second output signal of the at least one second sensor, wherein during filing the inner chamber and/or container the fluid first commences interaction with the at least one first sensor and then interaction with the at least one second sensor so that the fourth moment in time occurs after the third moment in time; and
c. Determining a degree of cleaning as a function of the third moment in time and the fourth moment in time.

Herein, it is preferred that in step c. a first time difference between the third moment in time and the fourth moment in time be evaluated.

In both of the aforementioned alternatives, it is proposed with the invention that in step c) a comparison is made of the third and/or fourth moment in time with at least one corresponding value that was determined in a filling process of the inner chamber and/or container essentially without a contamination, such as scale, soiling and/or corrosion.

Furthermore, the invention proposes that in step c) a fluid pressure in a line for filling the inner chamber and/or container with the fluid be taken into consideration, wherein the fluid pressure is preferably determined by measuring a second time difference between the third moment in time and the fourth moment in time when the inner chamber and/or container shows essentially no contamination.

Preferred embodiments of the invention provide that in step c), as a property of contamination, the degree of cleaning, the thickness of a contaminant, specifically of a scale layer, soil layer and/or corrosion layer, be determined at least in the region of the first and/or second sensor.

Furthermore, it is proposed with the invention that the inner chamber and/or container be filled with fluid up until the fourth moment in time and preferably from then on the corresponding filling level be maintained at the fourth moment in time, in an at least intermittently controlled manner.

A preferred embodiment of the invention provides that the first level, the second level, the third level, the fourth level, the first degree of cleaning, the second degree of cleaning, the third degree of cleaning, the fourth degree of cleaning, the fifth degree of cleaning, the sixth degree of cleaning, the seventh degree of cleaning, the eighth degree of cleaning, the ninth degree of cleaning, the tenth degree of cleaning, the eleventh degree of cleaning, the first difference, the second difference, the third difference, the fourth difference, the fifth difference, the sixth difference, the seventh difference, the eighth difference, the first degree of cleaning limit value, the second degree of cleaning limit value, the third degree of cleaning limit value, the fourth degree of cleaning limit value, the first speed limit value, the second speed limit value, the third speed limit value, the fourth speed limit value, the first difference limit value, the second difference limit value, the third difference limit value, the fourth difference limit value, the duration of action, the dosage of the cleaning agent, the time interval between two cleaning operations, the first moment in time, the second moment in time, the third moment in time, the fourth moment in time, the first time period, the second time period, the first interval duration, the second interval duration, the third interval duration, the adjustment value, the first time difference, the second time difference, the filling level up to the fourth moment in time, the first amount, the second amount, the third amount and/or the fourth among of the fluid, the first change, the second change, the third change, the first ratio, the second ratio, the comparison value, at least one quotient, the characteristic quantity, specifically the degree of hardness of the first fluid, at least one dosage recommendation and/or the message, preferably be stored and/or recalled in a memory device.

Finally, it is proposed for the method according to the invention, that the fluid-receiving device and/or inner chamber, and/or container be at least partially comprised of at least one vapor generator, preferably inoperable connection to at least one food-stuff processing apparatus, in particular comprised by it, of at least one quenching box, preferably in operable connection to the foodstuff-processing apparatus and/or comprised by it, and/or of at least on foodstuff-processing chamber comprised by the foodstuff-processing apparatus.

The object relating to the fluid-receiving device is achieved by a fluid-receiving device for use in a method according to the invention, comprising at least one evaluation means and the at least one inner chamber and/or container for receiving first fluid, whereby the evaluation means is arranged to carry out a method according to the invention.

Herein, it is proposed with the invention that the evaluation means be in operative connection with at least one fluid flow meter that is in operative connection with the inner chamber and/or container for the measurement of at least one amount of fluid introduced into the inner chamber and/or container, and/or with at least one fluid level sensor that is in operative connection with the inner chamber and/or container for the measurement of at least one level of the fluid in the inner chamber and/or container, wherein the evaluation means is installed in order to determine with the aid of a first change of a level of the fluid in the inner chamber and/or container measured with the fluid level sensor, the two fillings of the inner chamber and/or container occurring between the first filling and the second filling which is offset at least partly with respect to the first, to determine a second change measured with the fluid flow meter of the amount of fluid introduced into the inner chamber and/or container between at least the first and the second filling of the inner chamber and/or container and/or to determine with the aid of the third change of at least relation between the at least one fluid level in the inner chamber and/or container determined with the fluid sensor and at least the amount of the fluid introduced into the inner chamber and/or container measured with the aid of the fluid flow meter, between the at least first and second filling of the inner chamber and/or container, to determine a degree of cleaning of the fluid-receiving device and/or of the inner chamber and/or container and/or to determine a characteristic quantity of the fluid.

In both of the aforementioned alternative embodiments, it is provided that, as a characteristic quantity, at least one concentration of at least one thing, specifically the deposition of a first substance, such as a scale, can be determined in the second substance in the first fluid in the inner chamber and/or container preferably at least a degree of hardness, specifically the water hardness, of the first fluid.

Furthermore, for the fluid-receiving device, it is proposed that the fluid-receiving device comprise at least one memory device such as at least one RAM or ROM, in particular for storing the first degree of cleaning, the second degree of cleaning, the third degree of cleaning, the fourth degree of cleaning, the fifth degree of cleaning, the sixth degree of cleaning, the seventh degree of cleaning, the eighth degree of cleaning, the ninth degree of cleaning, the tenth degree of cleaning, the eleventh degree of cleaning, the first difference, the second difference, the third difference, the fourth difference, the fifth difference, the sixth difference, the seventh difference, the eighth difference, the first degree of cleaning limit value, the second degree of cleaning limit value, the third degree of cleaning limit value, the fourth degree of cleaning limit value, the first speed limit value, the second speed limit value, the third speed limit value, the fourth speed limit value, the first difference limit value, the second difference limit value, the third difference limit value, the fourth difference limit value, the duration of action, the dosage of the cleaning agent, the time distance in between two cleaning operations, the first moment in time, the second moment in time, the third moment in time, the fourth moment in time, the first time period, the second time period, the first interval duration, the second interval duration, the third interval duration, the adjustment value, the first time difference, the second time difference, the filling level at the fourth moment in time, the first amount, the second amount, the third amount and/or the fourth amount of the first fluid, the first change, the second change, the third change, the first ratio, the second ratio, the comparison value, at least one quotient, at least one level and/or at least one amount of fluid, the concentration of the second substance, the characteristic quantity and/or at least one comparison value, which is preferably in operative connection with the evaluation means.

It is also preferred that the fluid-receiving device, specifically the evaluation means, be in operative connection with at least one output device, in particular an acoustic, optical and/or tactile output device, such as a loudspeaker, a vibrator, a display device, specifically comprising at least one display and/or at least one LED, for the output of messages and/or information, specifically of the first, second, third, fourth, fifth, sixth, seventh, eighth, ninth, tenth and eleventh degrees of cleaning, of the dosage and/or dosage recommendation of the cleaning agent, of the cleaning agent components and/or of the third substance, of the time interval between two successive cleaning processes, of the duration of action of the cleaning agent, of the cleaning speed and/or of the determined characteristic quantity, to at least one user, specifically that at least one alarm can be output to the user.

Furthermore, it is proposed with the invention that the fluid-receiving device, specifically the evaluation means, be in operative connection with at least one dosage device, preferably for automatic combination of the third substance, of the cleaning agent, of the cleaning agent component, with the first fluid.

Furthermore, a fluid-receiving device according to the invention may have at least one inlet, specifically for the introduction of a fluid to the inner chamber and/or container, wherein preferably the fluid flow meter is in operative connection with the inlet.

An especially preferred embodiment of the invention provides that the fluid flow meter comprise at least one pulse counter.

Furthermore, it is proposed for the fluid-receiving device that the fluid-receiving device be designed at least partly as a vapor generator, quenching box and/or foodstuff-processing chamber preferably comprised by at least one foodstuff-processing apparatus.

Alternatively or additionally it can be provided that the fluid-receiving device, in particular in the form of vapor generator, comprise at least one heating device in operative connection with the inner chamber and/or container, preferably for heating, in particular for vaporizing fluid and/or at least one temperature measuring device, in particular for detecting the temperature of the fluid and/or of the heating device.

Furthermore, it is proposed with the invention that the evaluation means be in operative connection with the first contactless sensor and the second contactless sensor that are arranged outside the inner chamber and/or container, wherein the evaluation means is suitable for determining from a third moment of time at which the fluid commences interaction with the at least one contactless sensor and at a fourth moment of time at which the fluid commences operative connection with the at least one second contactless sensor, the presence and/or at least one property of the contamination.

Herein, in a first alternative embodiment, it is provided that the at least one first contactless sensor and the at least one second contactless sensor are arranged on the outside at the inner chamber and/or container.

In a second alternative embodiment it is provided that the at least one first contactless sensor is arranged on the outside at feed line and the at least one second contactless sensor is arranged on the outside at the inner chamber and/or container.

Especially preferred embodiments of the invention provide a third contactless sensor upstream from the second contactless sensor on the outside at the inner chamber and/or container, preferably in operative connection with the evaluation means.

For the fluid-receiving device, the invention further proposes that the heating device for the inner chamber and/or container be arranged in such a way that in the region of the at least one contactless sensor on the feed line, the fluid is not heated and thereby essentially does no contamination is formed.

It is also proposed with the invention that the two sensors arranged on the outside at the inner chamber and/or container be arranged adjacent one another, in particular so that at least partially touching.

Especially preferred embodiments of the invention provide that the at least one first, second and/or third contactless sensor is/are capacitive and/or inductive sensor/s.

Herein it is proposed with the invention that an electric or magnetic field of the at least one first, second and/or third sensor be directed inwardly.

Finally, a fluid-receiving device according to the invention can be characterized in that feed line leads into the inner chamber and/or container above or below the at least one second sensor.

The object relating to the foodstuff-processing apparatus is achieved by a foodstuff-processing apparatus, in particular a cooking apparatus, comprising at least one fluid-receiving device according to the invention.

Herein, the foodstuff-processing apparatus can be characterized by at least one control and/or regulation device in operative connection with the evaluation means, the container, the fluid flow meter, the fluid level sensor, the storage device, the output device, the first sensor, the second sensor, the third sensor, the heating device and/or the dosing device, whereby with the aid of the control and/or regulating device at least one cooking process and/or at least one cleaning operation, such as at least one process for removal and/or dissolution of cooking residues, a descaling process and/or a rinsing process can be controlled and/or regulated within the cooking apparatus, whereby preferably the evaluation means and the control and/or regulating device are produced in one piece.

Finally, the invention proposes that when performing a cleaning process the introduction and/or recirculation of the cleaning fluid, at least of a cleaning liquor and/or at least one clear rinsing agent is regulatable and/or controllable with the control and/or regulating device, wherein the cleaning fluid, the cleaning liquor and/or the clear rinsing agent preferably comprise the first fluid, the third substance, the cleaning agent and/or the cleaning agent components.

The method according to the invention, the fluid-receiving device according to the invention and the foodstuff-processing apparatus according to the invention are thus respectively based on the surprising insight that the conduct of the cleaning operation for an inner chamber and/or container of a fluid-receiving device can be optimized with regard to unnecessary interruptions of the operation or waiting times, increased chemical use and cost, by optimizing the action times as well as dosage of a cleaning agent and adaptation of a distance in time between successive cleaning operations and adjustment to the environmental conditions to the highest level possible. In particular, the method according to the invention allows a cleaning operation to be conducted automatically, that is without manual intervention by a user of the fluid-receiving device being necessary, so that the conduct of the cleaning operation can occur, unnoticed by a user, in the background. For example, the method according to the invention can be used for the descaling a vapor generator of a cooking appliance, although, the invention is not limited to such cleaning processes, and, in particular, other elements of the cooking appliance and/or fluid-receiving device of other foodstuff-processing apparatuses can be cleaned.

According to the method of the invention, first, in a first and second cleaning operation, wherein the first and second cleaning operation can be identical and can be descaling operations, a degree of cleaning or degree of scale forming of the inner chamber and/or container of the fluid-receiving device, for example, of the vapor generator, is determined. This can be effected, for example, in that an inner volume of the inner chamber and/or container is measured and in this way the degree of cleaning is determined. When the degree of cleaning at constant moments in time of the particular cleaning operation is recorded, for example, at the beginning of the first and of the second cleaning operation or at the end of the first and of the second cleaning operation, a cleaning speed, specifically a speed of the scale buildup in the vapor generator can be determined from the determined degrees of cleaning, by forming a time derivative of the difference of the degrees of cleaning. In particular, the time derivative is not performed over an absolute time interval between two descaling operations but via the change of the time of the fluid-receiving device, in particular the heating time of the vapor generator between the cleaning operations. According to the method of the invention, based on the cleaning speed or the difference of degree of cleaning thus determined, an optimization of the action time of a cleaning agent is first performed. Thus, action times of different length of the cleaning agent are assigned to different differences in degree of cleaning or cleaning speed differences. The optimum action times can be determined in particular empirically, for example, for a relatively small difference in the degree of cleaning and thus low cleaning speeds, a minimum action phase of 20 minutes of the cleaning agent, specifically the descaling agent, can be provided, while for large differences in degree of cleaning or large cleaning speeds, an action phase of up to 60 minutes can be provided. In this way, it is achieved that the cleaning process can be optimized with regard to the amount of necessary cleaning agent and at the same time the cleaning process can be adjusted to the given environmental conditions, for example, the hardness of the fluid introduced into the fluid-receiving device, such as water hardness. Specifically, it is avoided that unnecessarily long interruptions in the operation of the fluid-receiving device occur, since, in the manner described before, it is achieved that the action time of the cleaning agent is only as long as is necessary for sufficient cleaning.

If, however, it is recognized that even the maximum action time of the cleaning agent is not sufficient for satisfactory cleaning, in particular because a predetermined degree of cleaning limit value is exceeded, then it is recognized that adjustment of the action time of the cleaning agent is not sufficient, so that either the dosage of the cleaning agent a duration of an interval between two successive cleaning operations is adjusted, in particular both parameters are adjusted. This adjustment can in particular occur even when the cleaning speed determined in the manner described above exceeds a cleaning speed limit value. Specifically, it is recognized that a longer action time of the cleaning agent is no longer sufficient, and an increase of the dosage of the cleaning agent is performed. This increase of the dosage of the cleaning agent can be effected in predetermined steps, or be established as a function of the cleaning speed or of the determined degree of cleaning difference or the determined degrees of cleaning, specifically with the aid of empirically-derived values. An increase of the dosage can be effected automatically through a corresponding dosage device, or it can be provided that a user of the fluid-receiving device will be issued with a corresponding dosage recommendation.

Analogously, as an addition or as an alternative, a change in an interval duration between successive cleaning operations can also be effected. Thus, it can be provided that an adjustment of the dosage of the cleaning agent based on the degree of cleaning difference or cleaning speed but also based on a determined degree of cleaning is carried out or proposed, and that only when a degree of cleaning limit value is exceeded, adjustment of the interval duration is made. If after such an adjustment of the dosage of the cleaning agent or of the interval duration between successive cleaning operations, it is found that the cleaning speed has decreased, in particular if the degree of cleaning difference or the cleaning speed have become negative, then it is recognized that the adjustment of the dosage of the cleaning agent or the adjustment of the interval duration was successful. Then, in particular, a repeated adjustment of the dosage of the cleaning agent and/or of the interval duration between two subsequent successive cleaning operations can be performed. This is done in particular when the value found is again below the aforementioned degree of cleaning limit value. As a result of this, the cleaning process is again optimally adjusted to the given environmental conditions, in particular to a present contamination of the fluid-receiving device, so that unnecessary overdosage of the cleaning agent is avoided, or that it is avoided that cleaning processes have to be carried out at too short time intervals, which would lead to unnecessary interruptions of the operation of the foodstuff-processing apparatus.

Thus, optimum adjustment of a cleaning operation is achieved, in that specifically a first and second derivative with respect to time of a buildup of a contaminant such as a scale formation or of a degree of cleaning in an inside chamber and/or container of a fluid-receiving device is evaluated in order to adjust the action time of a cleaning agent, a dosage of the cleaning agent and/or an interval duration between successive cleaning operations.

In a preferred embodiment of the invention, adjustment of the dosage of the cleaning agent is effected, for example, in that the relationship proportion of the individual cleaning agent components of the cleaning agent is changed, specifically a dosage instruction is given to the user of the fluid-receiving device that states what amount of the particular cleaning agent component should be made available for the cleaning operation. Furthermore, an adjustment of the interval duration between two cleaning operations is performed in particular when a maximum dosage of the cleaning agent is reached, which is predetermined, for example, by the geometric measurements of a holding device for the cleaning agent, such as a basket for holding at least one cleaning tab. Thus, for example, the difference between a target dosage of the cleaning agent and an actual dosage of the cleaning agent during a cleaning operation can be stored as an adjustment value for a subsequent cleaning operation. When performing the subsequent cleaning operation, this adjustment value of the dosage of the cleaning agent is added.

Thus, through the method according to the invention, optimum adjustment of the conduct of cleaning operations is achieved. The determination of the cleaning speed, specifically of the scale formation rate, makes it furthermore possible that a residual (operating) time to a necessary descaling of the fluid-receiving device can be extrapolated, specifically with a constant usage and fluid quality such as water hardness.

The degree of cleaning can be determined specifically based on volume changes of the fluid-receiving device. Thus, the change of a level in the container (that is, the gradient of the level) at constant filling amounts, or the change of the filling amount at constant levels of the amounts of fluid introduced into the container between successive fillings of the container, depend on the degree of cleaning. For example, in the case of water, the amount of fluid depends on the thickness of the deposit of a first substance that follows from the presence of a second substance in the fluid, such as scale. Furthermore, from this, a characteristic quantity can be determined, for example, the degree of hardness of the water.

The degree of cleaning and/or the characteristic quantity, specifically the degree of water hardness, can be determined in the method according to the invention and in particular with the aid of the evaluation means in operative connection with the fluid-receiving device by a comparison of the change of the level (at constant amounts of filling) or of the change of the filling amounts (at constant levels) after a certain specific number of fillings of the container, which is chosen in such a manner that, for example, one can start from a measurable deposit of the first substance and thus from a change of the container volume, with corresponding stored comparison values, determined previously in particular for known water hardness degrees or cleaning degrees.

The degree of cleaning and/or the characteristic quantity, in particular the degree of hardness, can also be derived with the aid of a relation specifically determined with the fluid flow meter and the fluid level sensor, in particular of a quotient, from which the amount of fluid introduced to the container and the corresponding level of this fluid amount in the container, so that neither the introduced amount of fluid nor the level have to be kept constant. However, herein, as the case may be, changes of the relation, in particular of the quotients, as a function of the parameters of the container, for example, its geometry, have to be taken into consideration.

The corresponding comparison values can be measured by the manufacturer or by the end user before carrying out the method, specifically before the use of the fluid-receiving device, and are, according to one embodiment, stored in a memory device such as a data storage device that is connected to the means of evaluation, preferably comprised in the fluid-receiving device. These comprise specifically values that reflect the changes of the level at constant filling amounts or changes of the filling amount at a level kept constant in the container after a certain number of fillings for fluids with different characteristic quantities, such as the degree of water hardness, and different degree of cleaning. An interpolation can be performed in order to obtain comparison values that lie between the measured comparison values with which later values measured under operating conditions can be compared.

The degree of cleaning and/or the characteristic quantity can be determined in principle already with the determination of a single value (that is, level or amount of filling introduced or the quotient from these) after a number of fillings of the fluid-receiving device with the fluid, after a detectable change has occurred, and a comparison made with stored data corresponding to this number of fillings or degrees of cleaning for different characteristic quantities. The use of several measurements carried out in succession and, as the case may be, always after the same number of fillings yields a more accurate result, however.

With the aid of the determination of the degree of cleaning or a time derivative of the degree of cleaning, in particular using the characteristic quantity, one can make a dosage recommendation in the manner described above for a third substance to be combined with the fluid, specifically to be mixed with it and/or dissolved in it, and/or for the cleaning agent, such as a descaling agent or water softening agent for cleaning the fluid-receiving device. Thus, an overdosage or underdosage of the cleaning agent or of the third substance can be avoided and the operating costs can be optimized. Moreover, a dosage recommendation can be given for an additional cleaning agent which does not serve directly to cleaning the fluid-receiving device, but of which the dosage also depends on the characteristic quantity, in particular on the degree of hardness or of the degree of cleaning of the fluid-receiving device. For example, when using the fluid-receiving device in a cooking appliance, one can make dosage recommendations in the manner described above for a cleaning agent for forming a washing detergent or a rinsing agent, which is introduced to a foodstuff-processing apparatus or the cooking chamber of the cooking appliance, in particular is recirculated through it.

Thus, a method, a fluid-receiving device and a cooking appliance is further provided, with which a degree of cleaning of the fluid-receiving device and/or a characteristic quantity of the fluid, such as the degree of hardness of the fluid, specifically of water, is determined without a special sensor, for example, a conductivity sensor, but only with the aid of a fluid flow meter and a fluid level sensor. Since, logically, at least either the fluid flow meter or the fluid level sensor is present anyway in the fluid-receiving device such as a vapor generator, for example, in order to measure the amounts of fluids introduced to the fluid-receiving device automatically and to be able to prevent exceeding a maximum filling amount of the container, cost-effective realization of the fluid-receiving device according to the invention is possible. Moreover, the fluid flow meter and the fluid level sensor are very reliable measuring devices without complicated electronics, as a result of which long operating life of the fluid-receiving device according to the invention can be ensured.

By means of a dosage device, it is achieved that after determination of the degree of cleaning of the fluid-receiving device or of the characteristic quantity of the fluid in the manner described above, automatic dosage of the cleaning agent and/or third substance, such as a chemical, for example, a descaling agent, can be performed according to predetermined operating intervals, in particular also based on the determined degree of hardness.

By means of the previously-described conduct of the cleaning operations according to the invention, additional determinations of the properties of the fluid, in particular of the water hardness, can basically be omitted in order to control the correct dosage, for example, of the descaling agent or of the cleaning agent or to determine changes in the properties of the fluid, specifically the water hardness. A determination of whether correct dosage was achieved occurs automatically by means of a correspondingly-equipped fluid-receiving device after a cleaning of the container, in that, through the evaluation means and in particular with the aid of the measured values provided by the fluid flow meter and fluid level sensor, it is determined whether there is a difference between the filling volumes of a fluid-receiving device in the cleaned state after a preceding cleaning operation (the corresponding value of the filling volume is stored in the data storage), and the appropriate filling volume after a cleaning operation is available.

To detect a change of the filling volume and of the degree of cleaning, the fluid-receiving device is arranged in particular for the determination of a difference between, for example, the value of the level in the cleaned stage of the container after a preceding cleaning operation at a first moment in time stored in the data storage, and a measured level given the same amount of fluid at the second moment in time, or for the determination of the difference between the amount of fluid at the first moment in time and the measured value of the amount of fluid at a constant level at the second moment in time, also stored in the data storage, or also for the determination of the difference between a quotient of an amount of fluid measured at the second moment in time and a corresponding level and the stored quotient measured at the first moment in time for a cleaned container.

According to one embodiment, the fluid-receiving device comprises a means coupled with the fluid sensor or the evaluation means, in particular in the form of an output device for the output of a signal that is activated in case the level of the fluid in the container exceeds a predetermined value.

The signal can be an acoustic signal, a tactile or an optically-detectable signal, which is outputted for example, on a display or with the aid of at least one LED. In this way, an increase of the degree of cleaning in the container can also be signaled via a particular value, such as a degree of cleaning limit value.

Additionally, the fluid-receiving device can be arranged to determine whether a degree of cleaning detected after a cleaning operation is to be attributed to a change of the characteristic quantity of the fluid, such as the degree of hardness. For this purpose, a determination of the characteristic quantity, specifically the degree of water hardness, can be determined by the fluid-receiving device in the same way as described above.

The fluid-receiving device can also be arranged to allow the determination of a change of the characteristic quantity of the fluid, such as the water hardness, to enter into the previously-described conduct of a cleaning operation.

For the determination of a degree of cleaning, additionally or alternatively, it can be exploited that through the measurement of two moments in time, namely a third moment in time at which a liquid commences interaction with at least one first contactless sensor and a fourth moment in time at which the liquid commences into interaction with at least one second contactless sensor, based on a change of the output signals of the sensors, a contamination, specifically a deposit or scale layer can be detected on a container inner wall. The sensors are arranged for this purpose so that when the inner chamber and/or container are filled, the fluid first commences interaction with the first sensor and subsequently with the second sensor.

Herein, different arrangements of the sensors according to the invention are possible. Thus, the first and second sensor can be arranged on the outside at an inner chamber and/or container wall, or the first sensor can be arranged on the outside at an inlet of the container and the second sensor can be arranged on the outside at the container wall.

The term "interaction" is intended to mean that the sensor, for example, the first or second sensor, senses the presence of a fluid and/or a liquid in its particular sensor action region so that this sensor changes its output signal. In order to achieve accurate measurement of the cleaning processes, specifically of the deposited layer, it is advantageous to carry out a calibration with the container in a non-contaminated or scale-free state, for example, by calculating a liquid pressure of the liquid flowing into the container during the filling of the container.

Due to a contamination, in particular a deposit or scale layer on a container wall and/or on the bottom of a container, a time difference between the two previously-described moments in time may be shortened in comparison to the situation without or with a slight deposit or scale layer, namely when the liquid pressure in the feed line of the container remains the same.

BRIEF DESCRIPTION OF THE DRAWINGS

Other characteristics, properties and advantages of the present invention follow from the description given below, in which embodiments are explained in detail with reference to the schematic drawings. These show the following.

DETAILED DESCRIPTION

With the aid of FIGS. 1 to 4*b*, first of all the structure of different embodiments of a fluid-receiving device according to the invention will be explained, in particular the determination of a degree of cleaning, and then using FIGS. 1 to 4*b* the course of a method according to the invention will be described.

Figure 1:
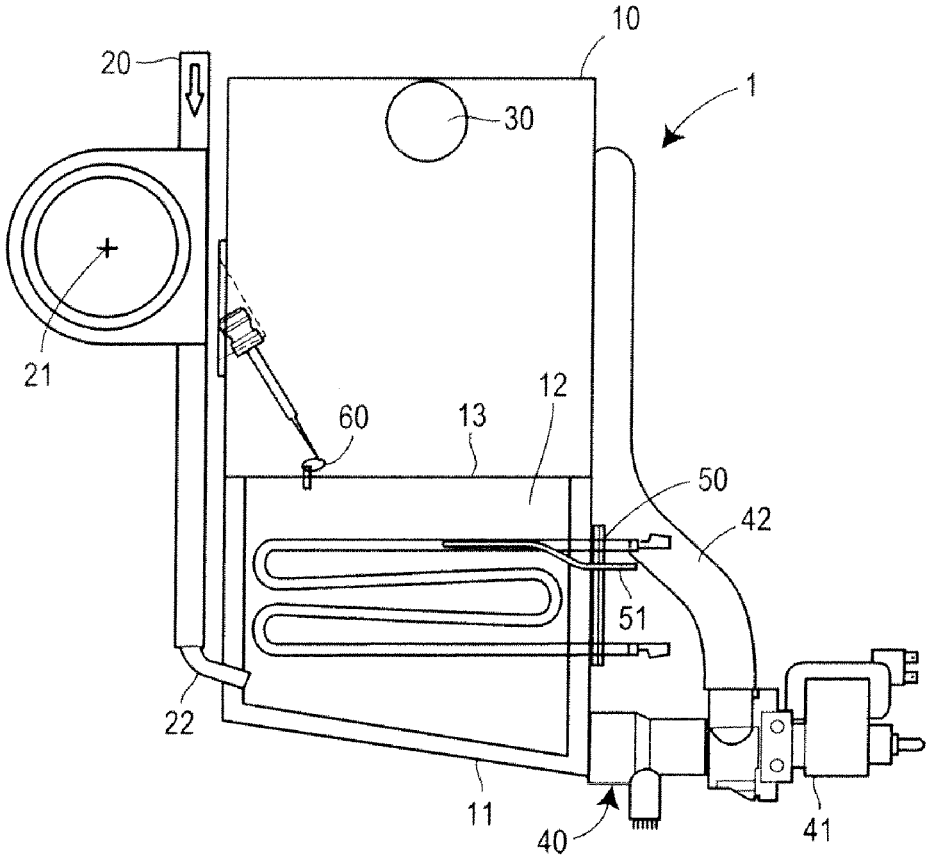
FIG. 1 is a cross-section of a first fluid-receiving device according to the invention in the form of a vapor generator 1 for a cooking appliance.

As can be seen in FIG. 1, the vapor generator 1, when in operation, heats a first fluid in the form of water 12 in a container 10 with a water inlet 20, a vapor discharge 30 and a discharge unit 40 comprising a discharge pump 41 and a discharge tube 42 over a heating device in the form of a heater 50. Moreover, within container 10 a fluid sensor is arranged in the form of a water level sensor 60. Such a vapor generator 1 is suitable for a foodstuff-processing apparatus, specifically for a cooking appliance, such as that used in combination operations with hot air and hot steam, for table-top and free-standing devices for gastronomy, large kitchens and similar, whereby the vapor discharge 30 feeds into a steam outlet 30 opens into a foodstuff-processing chamber or cooking chamber, not shown.

The illustrated vapor generator 1 operates as follows:

For the startup, water flows into container 10 through water inlet 20, a fluid flow meter 21, for example, a pulse counter, that detects the amount of water filled, and a filling tube 22. There, the water 12 is heated by heater 50, the temperature of which is detected by a temperature measuring device in the form of a temperature sensor 51, and is finally vaporized.

In the course of operation of the vapor generator 1, among other things contaminants or deposits of a first substance in the form of scale deposits 11 form on the walls of container 10. These deposits 11 are to be attributed to the presence of at least one second substance, such as calcium carbonate, in the water 12, and these form upon heating the water 12. These deposits 11 cause either the nominal water level 13 that is determined with the aid of water level sensor 60 to increase even though the amount of water introduced through the fluid flow meter 21 is constant, or, in the case of a level-regulated filling of the water using a water level sensor 60, the amount introduced through the fluid flow meter 21 to decrease.

By determining the change of the level of fluid in the form of water 12 (that is, of the gradient of the level) in container 10 with the aid of the water level sensor 60 between successive fillings of the container 10 with the same amount of water, measured with the fluid flow meter 21, and by comparison with measured values determined before, in particular for a series of fluids with different properties, specifically different degrees of hardness, and stored in a memory device (not shown) in the form of a data storage, using evaluation values through evaluation means (not shown) provided in the steam generator 1, for example, a microprocessor or any arbitrary other suitable electronic computing device, that is in operative connection with the water level sensor 60 and the fluid flow meter 21, a degree of cleaning, specifically of the vapor generator 1, can be determined. Furthermore, a characteristic quantity of the water 12, in the form of the degree of hardness of the water 12, can be determined, since the magnitude of the increase of the level (with constant amount of water being introduced) between successive fillings is dependent on the degree of hardness of the water. The higher the water hardness, the thicker the scale deposit in container 10 and the rise of level in container 10. The change of the level of the constant amount of water introduced into container 10 and thus the degree of cleaning or the hardness of the water can be determined, for example, with the aid of a single measurement, for example, after ten fillings. However, a more accurate result is obtained upon repeated measurements over a longer period of operation (for example, a total of 20 fillings of the container), for example, after five fillings, respectively, and by comparison with corresponding comparison values stored in the data storage of the vapor generator 1. Alternatively, the determination can also be performed by determining the change of the amount introduced with the aid of measured values delivered by the flow meter 21 at constant levels measured by the water level sensor 60, or by determining the change of the ratio of filling amount of level and comparison with stored values.

Previously-determined measured values suitable for comparison can also be stored in the memory device, for example, in the form of a RAM or ROM, that is accessible to the valuation means.

Theoretically, the determination of the degree of hardness has to be effected only once for a given water hardness, for example, when the vapor generator 1 is first started up, at a water connection with water 12 of a given constant water hardness. As soon as the degree of hardness of water 12 is known, this can be used specifically in the conduct of a cleaning operation explained below, in particular for the adjustment of an action time of a cleaning agent, dosage of the cleaning agent and/or an interval duration between cleaning operations.

The descaling or cleaning of the vapor generator 1 can be carried out automatically in the manner described below using a dosage device (not shown) connected to the vapor generator 1 for a descaling agent or cleaning agent. The dosage device is coupled to the evaluation means and, as will be explained below, doses an amount, in particular corresponding to the degree of harness of the water, of the descaling agent or cleaning agent automatically, as explained below.

The use of the characteristic quantity of the water 12 determined by the evaluation means of the vapor generator 1 is not limited to the conduct of a cleaning operation that serves to clean the container 10 of the vapor generator 1. Thus, the evaluation means can transmit the determined characteristic quantity to a control and/or regulating device of the cooking appliance or the control and/or regulating device can recall the determined characteristic quantity from the data storage. In particular in large kitchens, it is customary that a cleaning of the foodstuff-processing apparatus is performed automatically. Usually a washing fluid or a rinsing liquor is recirculated through at least in one inner chamber of the foodstuff-processing apparatus, in particular a cooking appliance, in order to remove residues or similar from the walls of the inner chamber. In particular the inner chamber is a cooking chamber of the cooking appliance. The washing liquor or the rinsing fluid is usually formed by dosed feeding of a cleaning substance in to a fluid, in particular water. This can be effected, for example, with an automatic dosage device or by giving a user instructions for the introduction of the cleaning substance into the inner chamber. Herein, the dosage of the cleaning substance or rinsing substance depends on the properties of the water, in particular on various characteristic quantities, such as the degree of hardness of the water. Based on the fact that with the evaluation means, in particular the degree of hardness of the water can also be determined, a more precise dosage of the cleaning agent or the rinsing agent that is used for the cleaning of the inner chamber, such as the cooking chamber of the cooking appliance, can thus be achieved. In this way, too, a reduction of the possible pollution of the environment, a reduction of the operating cost of the cooking appliance, as well as an improvement of the cleaning result are achieved, since underdosage or overdosage of a cleaning agent or rinsing agent is avoided.

With the aid of FIGS. 2 to 4*b*, with the aid of alternative embodiments of a fluid-receiving device, an alternative determination of the degree of cleaning that can be used in the method according to the invention, in particular at a first and second moment in time, will now be explained.

Figure 2:
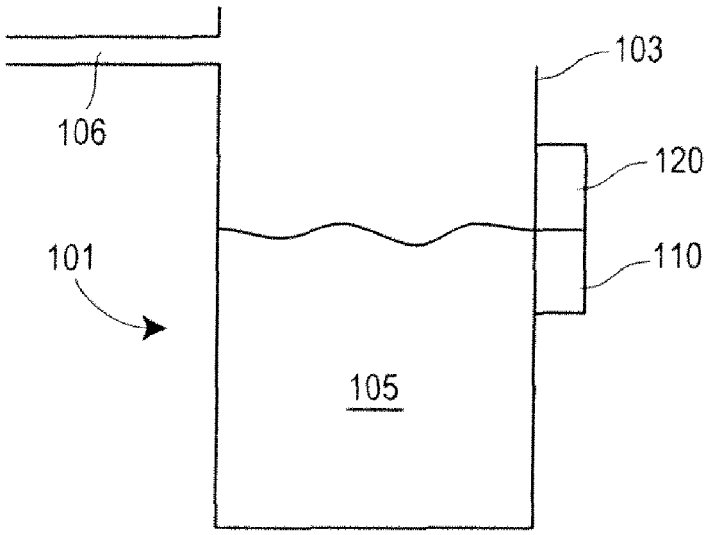
FIG. 2 is a sectional representation of another fluid-receiving device according to the invention.

According to FIG. 2 a second fluid-receiving device according to the invention comprises specifically as part of a vapor generator of a cooking appliance a container 101 with a wall 103 on which a first contactless sensor 110 and a second contactless sensor 120 are arranged, namely one above the other outside the container 101. The container 101 is always filled with a first fluid in the form of water 105 through a feed line 106 in such a way that the level of the water 105 is located between the first sensor 110 and the second sensor 120.

Figure 3A:
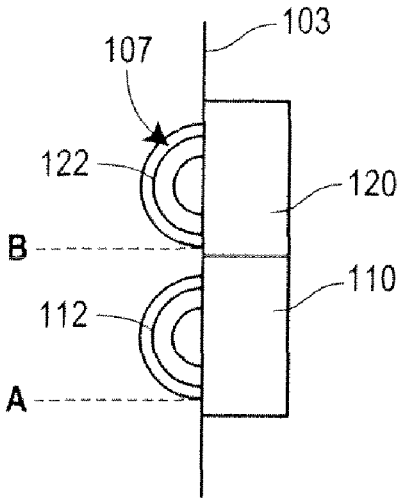
FIG. 3*a* is an enlarged representation of a section of FIG. 1 without scale deposit.
Figure 3B:
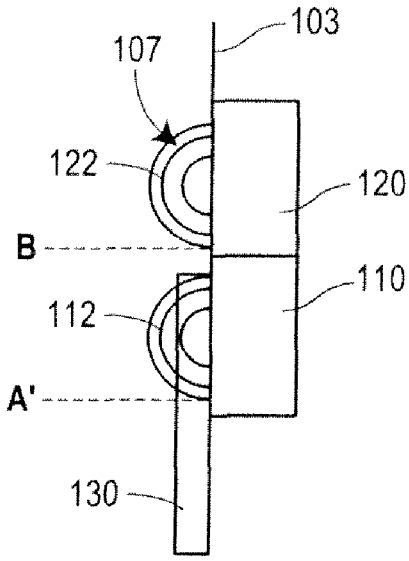
FIG. 3*b* is an enlarged representation of a section of FIG. 1 with scale deposit.

In order to explain the function, an enlarged representation is shown in FIGS. 3*a* and 3*b*, respectively, of the first and second sensors 110, 120, each of which is a capacitive sensor and has an electric field 112, 122 directed inwardly, and the operative regions of which as determined by the fields 112, 122 are shown.

Thus, when the container 101 is filled with water 105 for the first time, that is, either directly after manufacture or after a thorough inner cleaning, during which substantially all possible deposits have been removed from its wall 103, as can be seen in FIG. 3*a*, water commences interaction at a third moment in time, namely when exceeding a level A, with the first sensor 110, due to the water 105's altering the permittivity of the electric field 112 of the first sensor 110. At this first moment in time, the first sensor 110 immediately gives off an altered output signal to a control and/or regulating unit which is not shown. If the container 101 is filled further, namely until the second sensor 120, which is constructed functionally in the exact same way as the first sensor 110 reports to the control or regulating unit at a second moment in time that the water has reached a level B and thus the operative region of the second sensor 120, then the supply of water is turned off so that a region 107 of the wall 103 in the operative region of the second sensor 120 is not covered with water. The time difference between the third moment in time and the fourth moment in time in the new scale-free state of the container 101 or a water pressure circulated from this are stored in the control or regulating unit.

FIG. 3*b* now shows the influence of a contaminant in the form of a scale layer 103 that has been deposited during the operation of the container 101 on the wall 103 of it. The region 107 of the wall 103 has no scale layer, since this is not covered with water 105, but the scale layer 130 that now allows the water 105 to interact with the first sensor 110 only to a reduced extent, reduces the operative region of the first sensor 110. The scale layer 130 hereby has a permittivity which is of the order of magnitude of that of air, so that even with the scale layer 130 the presence of water 105 in the operative region of the first sensor 110 can also be detected. Then, if water 105 is introduced into the scale container 101, the first sensor 110 detects that water only upwards of a level A' due to the inward-directed field lines of the electric field 112, this level lying above the level A without scale layer 130 (see FIG. 3*a*) at a modified third moment in time, which lies beyond the third moment in time described with reference to FIG. 3*a*, but lies before the fourth moment in time described there. If now, as in the previous case, water continues to be introduced, then the second sensor 120 recognizes at the fourth moment in time the surpassing of level B. Namely no scale is deposited in region 107 of wall 103 before the second sensor 120, since the level of the water is always kept between the two sensors 110, 120, so that the water level B of FIG. 3*b* corresponds to the water level B of FIG. 3*a*.

When the water 105 is thus introduced with the same water pressure into differently contaminated or scaled states of the container 101 into container 101, then the time difference between the recognition of water by the first sensor 110, that is, at the third moment in time, and the second sensor 120, that is, at the fourth moment in time, is reduced due to a lower level difference B-A' in the more heavily scaled state in comparison to the level difference B-A in the less scaled or scale-free state. That means that the time difference between the switching time of the first sensor 110, that is, the first moment in time, and the switching time of the second sensor 120, that is, the second moment in time, is a measure of a degree of cleaning of the container 101 or of the buildup of scale within the container 1.

In an embodiment of the first device, the electric field 112 of the first sensor 110 can be adjusted so that at a given thickness of the scale layer 130, no water 105 commences interaction with the first sensor 110 any more, but only with the second sensor 120. This characteristic also allows the detection of a scale layer 130. In this case, the time difference between the third moment in time and fourth moment in time, although not explicitly measurable, is measurable implicitly, since at the fourth moment of time, the third moment of time already had to have occurred, namely at the latest when the water reaches the level at which the electric field 112 of the first sensor 110 penetrates most deeply into the container 101.

Figure 4A:
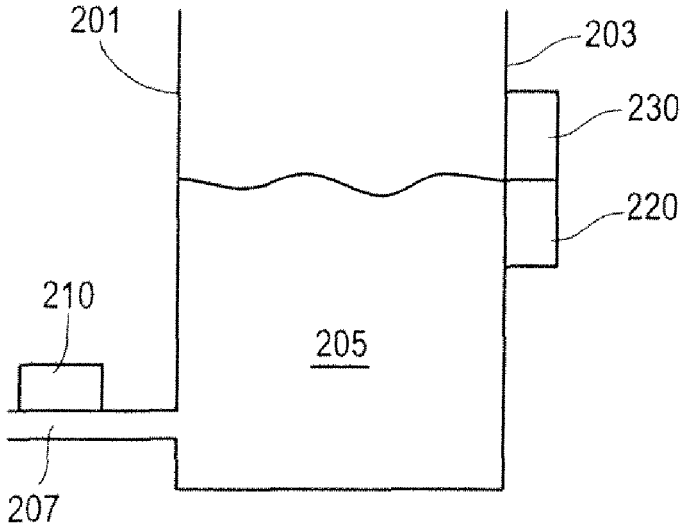
FIG. 4*a* is a sectional representation of a third fluid-receiving device according to the invention without scale deposit.
Figure 4B:
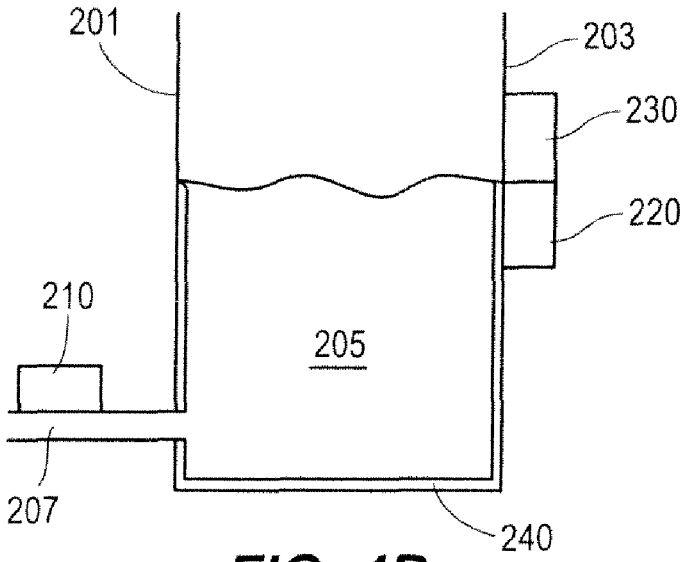
FIG. 4*b* is a representation as in FIG. 4*a*, but with scale deposit.

In a third fluid-receiving device according to the invention, for example, again as a part of a vapor generator, as shown in FIGS. 4*a* and 4*b*, a container 201 with a container wall 203 is filled with water 205. Furthermore, the container 201 has an inlet 207 on which a first sensor 210 is arranged. On the wall 203 of container 201 a second sensor 220 is arranged. Moreover, a third sensor 230 can also be arranged on the wall of container 201. The first sensor 210, the second sensor 220 and optionally the third sensor 230 are arranged on the outside of the wall 203 of container 201 or are arranged on the outside of inlet line 207 without the wall 203 of the container 201 or the wall of the line 207 having an opening or such like. Similarly to the first device, the first, second and third sensors 210, 220, 230 are capacitive sensors. Upstream of the first sensor 210, moreover, a valve is arranged which is not shown, through which the intake of water 205 can be controlled or started or stopped.

In a clean or new state of the container 201, in which it is not yet have scaled (see FIG. 4*a*), the fluid-receiving device according to the invention is calibrated. For this purpose, first, the first sensor 210 detects at a third moment in time the presence of water 205, and at a later, fourth (fifth) moment in time the fourth (fifth) sensor 220 (230) also detects the presence of water 205. The filling volume of the container 201 being known, now the water pressure or a time difference between the third moment in time of the water detection and the fourth (fifth) moment in time of the water detection is calculated and they are stored in a control or regulating unit, which is not shown.

In FIG. 4*b*, one can see the same container as in FIG. 4*a*, but after the deposition of a contamination in the form of a scale layer 240 on the inside on wall 203. No scale layer is developed in the inlet 207 because usually this is not heated. The first sensor 210 should thus be arranged preferably at a location in feed line 207, through which the container 201 is filled with water, but where as far as possible no scale is deposited. If now the container 201 is filled with water in the scaled state, then the volume of container 201 to be filled is reduced by the scale layer 240. Since the water pressure during the filling of the container 201 is kept constant and the container 201 now fills up more rapidly due to the smaller volume, the time difference between the sensing of water at the first sensor 210, that is at the third moment in time, and at the second sensor 220 (at the third sensor 230), that is at the fourth (fifth) moment in time, is shortened. Using a comparison between the sensing of water in the scale-free state and in the lime-deposited state via the first, second and/or third sensor 210, 220, 230, the degree of contamination, in particular the buildup of scale or of the scale layer 240 can thus be detected and calculated.

In the third fluid-receiving device it can be advantageous moreover that no accurate filling height has to be maintained as was the case with the first device, and thus, for example, the operative region of the second sensor 220 is not completely scaled.

The value of the water pressure can be used for self-cleaning of the container or other systems in the cooking appliance into which the container 101, 201 is built in. Furthermore, the information about the volume decrease due to the scale layer 130, 240 can be used as a scale diagnosis system, specifically for a display.

All the embodiments described above can be operated with capacitive as well as with inductive sensors. Naturally, the measurement method for the detection of a degree of contamination, specifically scaling, of the described embodiments can be combined with one another.

Now the course of a method according to the invention will be explained by means of FIGS. 5 and 6.

Figure 5:
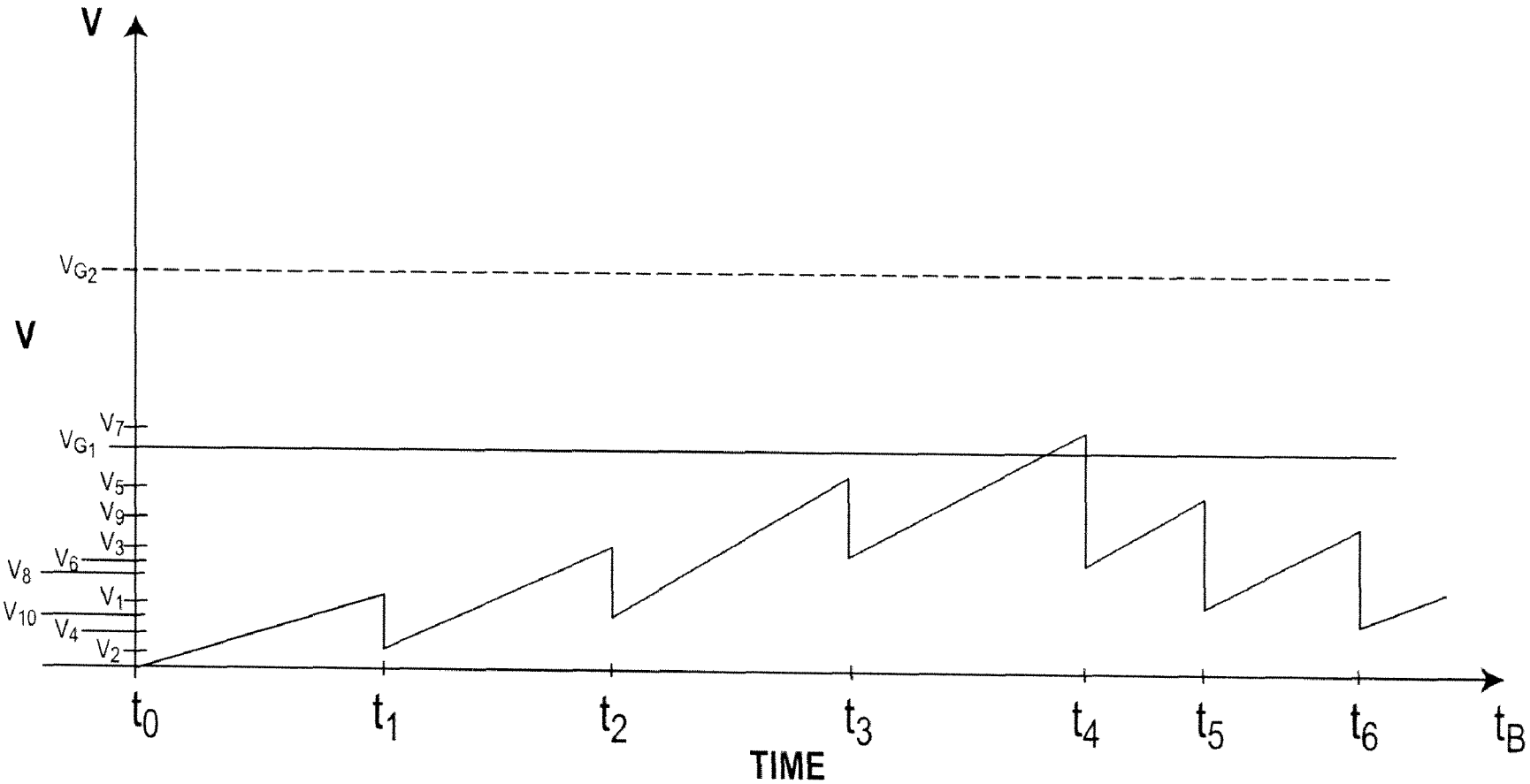
FIG. 5 is a first graphic plot of a degree of cleaning of a fluid-receiving device according to the invention as a function of the time of operation of the fluid-receiving device.

In FIG. 5, a degree of cleaning of a fluid-receiving device is plotted as a function of time. More accurately, a degree of scaling V of a vapor generator is plotted as a function of the time of operation $t_B$. At time $t_0$, the vapor generator is in a completely clean state, while at operating points $t_1$, $t_2$, $t_3$, $t_4$ and $t_5$, the cleaning operations, specifically the descaling operations are performed in the vapor generator.

After the vapor generator has been put into operation at the moment in time $t_0$, as a result of the heating of the water in the vapor generator, contaminations in the form of scale arise, so that the scaling of the vapor generator increases up to time point $t_1$ to a scaling value $V_1$. At moment in time $t_1$ then a scaling process is performed. To this end, in particular in the case of the vapor generator when performing a cleaning of a cooking chamber of the cooking appliance, a rinse liquor which is recirculated in the cooking chamber is introduced at least partly. A rinsing liquor mostly contains an acid, such as citric acid, which in addition to the rinsing effect also has a scale-dissolving effect.

The descaling agent is dosed at empirically determined values based on the degree of scaling $V_1$ and the residence time or the action time of the cleaning fluid in the vapor generator is determined also based on empirically determined values as a function of the degree of scaling $V_1$. This descaling operation, as can be appreciated from FIG. 5, leads to a decrease of the degree of scaling from a value $V_1$ to the value $V_2$. The degree of scaling is determined in particular in the manner indicated in FIG. 1, that is, the different inner volumes of the vapor generator are determined and a conclusion regarding the degree of scaling in the vapor generator is reached from the change of the inner volume.

As can further be seen from FIG. 5, the degree of scaling $V_1$ that is determined at a first moment in time of a first cleaning operation, namely at the beginning of the descaling operation at operating time point $t_1$, lies below a first scaling limit value $V_{G1}$. This is also true <the second moment in time> for the degree of scaling $V_2$ that is determined at the <. . . > end of the descaling operation carried out at operating time $t_1$. In this case, the descaling operation carried out at operating time $t_1$ represents both a first as well as a second cleaning operation. According to the method of the invention it is recognized that in this first case here present, the first as well as the second degrees of lime scaling $V_1$, $V_2$ lie below the first scaling limit value $V_{G1}$, and at first only an adjustment of the action time of the cleaning agent for subsequent descaling operations is effected. The degree of adjustment can be determined in different ways, for example, based on the absolute values of the degree of cleaning or degree of scaling based on difference values between degrees of scaling or of cleaning rates or scaling rates, whereby in these can be defined in different ways. Thus, in the present case, as a function of the magnitude of the degree of scaling $V_2$ the time of the cleaning agent can be increased for subsequent cleaning operations.

During the operation of the vapor generator from operating time $t_1$ to operating time $t_2$, the degree of scaling of the vapor generator increases from scaling degree $V_2$ to scaling degree $V_3$. Due to the previously performed adjustment of the duration of exposure to the cleaning fluid in the vapor generator during the scaling operation carried out to moment in time $t_2$, the degree of scaling decreases to operating time $t_2$ from a degree of scaling $V_3$ to the degree of scaling $V_4$. The difference between the degree of scaling $V_1$ and the degree of scaling $V_2$ is smaller than the difference between the degree of scaling $V_3$ and the degree of scaling $V_4$. It follows from this that the cleaning action is increased in the case of the scaling operation carried out to operating time $t_2$ is increased in comparison to the descaling operation carried out at time $t_1$.

For optimum conduct of scaling actions carried out in succession, an evaluation of the second scaling operation at operating time $t_2$ can be carried out in the following way. As a first moment in time of a first cleaning operation, the moment in time at the end of the scaling operation performed up to operating time $t_1$ can be chosen. As explained before, at this first point in time, the degree of scaling $V_2$ is determined. As a second moment in time of a second scaling operation, first the initiation time of the scaling operation carried out to operating time $t_2$ can be chosen. Thus, at this moment in time the degree of scaling $V_3$ is determined. Thus, the degree of scaling $V_2$ represents a first degree of cleaning, while the degree of scaling $V_3$ represents a second degree of cleaning. If the rate of scaling is defined according to a first definition as a change over time of the degree of scaling between the end of a first descaling process and the beginning of a subsequent cleaning process, then it follows from a derivative of the scaling development between the operating times $t_1$ and $t_2$ that the rate of scaling has increased in the operating time interval from $t_1$ to $t_2$ in comparison to the operating time interval $t_0$ to $t_1$.

This can, for example, be attributed to the fact that the cooking appliance is operated in different modes of operation so that more rapid scaling occurs in the vapor generator.

Depending on the rate of scaling determined according to the previous first definition, the action time of the descaling agent can be established for subsequent descaling operations. In other words, the buildup of scale in the vapor generator is determined by forming the first derivative with respect to operating time and, through a comparison between the moments in time $t_0$ to $t_1$ and $t_1$ to $t_2$, different rates of scaling will be assigned action phases of different length. Furthermore, as a first moment in time of the first cleaning operation one can choose the end time point of the descaling operation carried out up to operating time $t_1$ and as the second moment in time of a second descaling operation the end point of the descaling operation carried out up to operating time $t_2$. The difference between the degrees of scaling $V_4$ and $V_2$ is positive. Also, based on the magnitude of the amount of the degree of scaling $V_4$ or on the amount of the first difference formed from the difference between the degrees of scaling $V_4$ and $V_2$, the action duration of the cleaning agent can be adjusted or lengthened for the subsequent descaling operations by a first time period. This first time period can thus be determined alternatively or additionally with the aid of the magnitude of the degree of scaling $V_4$ determined at the second moment in time of the second cleaning operation, on the basis of the previously determined scaling rate and/or based on the defined first difference. The determination of the rate of scaling according to the previously listed first definition furthermore provides the advantage that a rest time up to a necessary next descaling of the vapor generator can be extrapolated if the utilization and water quality remain the same.

Subsequently, the vapor generator is set into operation again from operating time $t_2$ to operating time $t_3$, and, at operating time $t_3$ at which a degree of scaling $V_5$ is reached, another cleaning operation is performed. However, as can be seen from FIG. 5, the lengthening of the action duration of the cleaning agent during this descaling operation does not lead to a greater reduction of the degree of scaling. In particular, the difference between the degrees of scaling $V_3$ and $V_4$ corresponds to the difference between the degrees of scaling $V_5$ and $V_6$. However, since the degree of scaling $V_5$ is still always below the degree of scaling limit value $V_{G1}$, for the subsequent descaling operations at first the same dosage of the descaling agent is used as for the operating interval duration between successive descaling operations. After the vapor generator is put into operation to produce vapor again from operating time $t_3$ to operating time $t_4$, the degree of scaling at operating time $t_4$ has increased to a degree of scaling $V_7$, which lies above the degree of scaling limit value $V_{G1}$.

As follows from the course of the degree of scaling from operating time $t_2$ to the operating time $t_4$, the rate of scaling determined according to the above first definition, that is, from the time derivative of the degree of scaling from operating time $t_2$ to operating time $t_3$ and from operating time $t_3$ to operating time $t_4$ has increased so much that even a predetermined scaling rate limit value would have been exceeded. However, a mere adjustment of the action duration of the cleaning agent in the form that a longer action duration is chosen can no longer compensate for the increased scaling. In order to prevent, due to the long action times of the descaling agent, the occurrence of unnecessarily long interruption of the operation of the cooking appliance, the descaling operation carried out at operating $t_4$ is effected by choosing a higher dosage of the descaling agent. This can be done for example by a suitable control of a dosage device for automatic dosing of the descaling agent or by suggesting a stronger, that is, higher dosage descaling program to the user, in particular by output of a corresponding dosage recommendation for the descaling agent. Herein cleaning means or cleaning agent systems can be used in which the cleaning agent is formed by multiple variably dosable cleaning agent components. For example, if these are stored in the form of tablets or tabs, cleaning agent components of an alterable composition are provided so that a very precise adjustment of the dosage or concentration of the cleaning agent can be achieved. Herein the dosage, that is, the number of tablets or tabs, can also be influenced, in addition to the previously described scaling differences or the operating time of the vapor generator, by the absolute value of the degree of scaling; that is, for example, the difference of the actual volume of the vapor generator and a target volume in a completely descaled state, at the end of a descaling operation.

However, when using such a cleaning agent system, one can encounter situations in which the uptake capacity of a holding device for the tablets or tabs is no longer sufficient to hold the desired number of tablets or tabs. In this case, it is recognized that the actual dosage of a cleaning agent does not correspond to a target dosage. According to the method of the invention, based on this deviation, an adjustment value is determined. This adjustment value corresponds to that dosage of the cleaning agent by which the dosage of the cleaning agent must be increased in a subsequent cleaning or descaling operation. In particular, a situation arises that due to the further increased dosage of the cleaning agent a different composition of the tablets or tabs must be chosen so that the uptake capacity of the holding device is sufficient <for this dosage>.

If for an evaluation of the result of the descaling operation or for an adjustment of subsequent descaling operations the descaling operation carried out at operating time $t_3$ is chosen as the first descaling operation and as first moment in time, the end of the descaling operation that was carried out up to this operating time $t_3$, then the scaling degree $V_6$ is determined as first degree of scaling for the evaluation. As second descaling operation, the descaling operation to be carried out at operating time $t_4$ can be chosen and as second moment in time of this descaling operation, the beginning thereof, so that the degree of scaling $V_7$ is determined as second degree of scaling for an evaluation. Based on the difference between the degrees of scaling $V_6$ and $V_7$, according to the method of the invention an increase of the dosage of the descaling agent is effected. Into this increase of the dosage of the descaling agent, furthermore, the time derivative of the first difference between the degrees of scaling $V_6$ and $V_7$ over the operating time can enter, that is, the scaling rate according to the above first definition.

As will be appreciated further from FIG. 5, the scaling degree decreases from scaling degree $V_7$ to scaling degree $V_8$, and, compared to the descaling operation carried out at operating time $t_3$, in which the degree of scaling merely decreased from scaling degree $V_5$ to scaling degree $V_6$, the increase of the descaling agent dosage leads to the degree of scaling being reduced merely strongly in the descaling operation carried out at operating time $t_4$, namely, to the amount of the difference between the scaling degree $V_7$ and the scaling degree $V_8$. Parallel to the establishment of a higher dosage of the descaling agent in subsequent descaling operations, further, a reduction of duration of the interval between subsequent, successive descaling operations is effected, based on the scaling rate determined according to the above first definition between the operating time $t_3$ and $t_4$ of the vapor generator. This is done in particular because the descaling degree $V_7$ lies above the first descaling degree limit value degree $V_{G1}$. Based on the increased rate of descaling between operating times $t_3$ and $t_4$, the distance in time between subsequent successive descaling operations is shortened by a second interval duration, so that the next descaling operation is carried out already at (an earlier) operating time $t_5$.

At operating time $t_5$ the degree of scaling of the vapor generator has increased from the degree of scaling $V_8$ to degree of scaling $V_9$, so that the descaling operation carried out at operating time $t_5$ causes the degree of scaling to drop, due to the higher dosage of the descaling agent as well as due to the shortened time distance of this descaling operation to operating time $t_4$, to a degree of scaling $V_{10}$, which lies below the degree of scaling $V_8$. When the difference between the degrees of scaling $V_8$ and $V_{10}$ is obtained, it can be seen that the difference between degrees of scaling $V_8$ and $V_{10}$ is negative. Thus the increase of dosage was successful. If one uses for the determination of a cleaning speed or scaling rate an alternative, second definition, namely a time derivative of a first difference between the degree of cleaning present at the end of a first cleaning operation and the degree of cleaning present at the end of a second cleaning operation, then the following is obtained in this example: the difference of the degree of scaling $V_8$ present at the end of the descaling operation carried out operating time $t_4$ and the degree of scaling $V_{10}$ present at the end of the descaling operation carried out at operating time $t_5$ is calculated, and this is divided by the operating time difference $t_5-t_4$. Since the difference $V_8-V_{10}$ is negative, according to this second definition a negative cleaning speed or scaling rate is obtained. Since both the degree of scaling $V_8$ and as well as the degree of scaling $V_{10}$ lie below degree of scaling limit value $V_{G1}$, for the subsequent descaling operations, both the dosage of the descaling agent is reduced, in particular proportionally to the difference between the two degrees of scaling $V_8$ and $V_{10}$, and, moreover, the action duration of the descaling agent is reduced in the subsequent descaling operations due to the negative scaling rate according to the second definition. In addition, the interval duration between the descaling operations is increased again so that the next descaling operation will be performed after an operating time span that is greater than $t_5-t_4$, at operating time $t_6$. In this way, it is achieved that both unnecessary environmental pollution and increased costs due to high chemical use and also unnecessarily long interruptions of the operation of the cooking appliance due to the longer action time of the cleaning agent or too high descaling operation frequencies are avoided.

In spite of this reduction of the descaling agent and shortening of the action time, the degree of scaling after the descaling operation carried out at operating time $t_6$ is of a degree of scaling value that is lower than $V_{10}$. Thus, the action duration of the cleaning agent in the subsequent descaling operations is reduced further, in particular due to the negative scaling rate obtained according to the second definition. Thus, due to the second derivative of the scaling rate with respect to operating time, adjustment of the descaling operations according to the method of the invention is performed.

In the manner described before, the descaling operations carried out in the vapor generator are conducted optimally, since both unnecessary use of chemicals that leads to unnecessary environmental pollution and unnecessary frequency of interruptions in the operation of the cooking appliance due to the necessity of carrying out the descaling operations is avoided, in that below a scaling limit value $V_{G1}$ only an adjustment of the duration of the action of the descaling agent is made, and only when the degree of scaling lies above the degree of scaling limit value $V_{G1}$ will adjustment of the dosage of the descaling agent as well as adjustment of the interval duration between subsequent descaling operations be performed. Due to this adjustment of the dosage of the descaling agent, it is achieved that unnecessarily long interruptions in the operation of the cooking appliance due to long action times of the descaling agent are avoided during the descaling operations.

These goals are achieved in particular by the fact that through the method according to the invention, both a first derivative of the degree of scaling with respect to the operating time as well as a second derivative of the degree of scaling with respect to the operating time are evaluated. This, then, <up to operating time point $t_4$> y means of evaluation of the degree of scaling at the beginning of the descaling operations carried out at operating times $t_1$, $t_2$, $t_3$ and $t_4$ leads to a positive first derivative < . . . >. The scaling rate calculated according to the above second definition is positive, so that, below the degree of scaling limit value $V_{G1}$ it leads to an increase of the action duration of the descaling agent, and at the time at which the degree of scaling increases above the degree of scaling limit value $V_{G1}$, both adjustment of the dosage of the descaling agent as well as a shortening of the interval times for subsequent successive descaling operations take place This causes, starting from operating time $t_4$, the scaling rate calculated according to the above second definition to become negative, so that the second derivative of this degree of scaling with respect to the operating time also changes. Based on this negative second derivative, both the action time of the descaling agent and the dosage of the descaling agent are reduced for subsequent descaling operations and, furthermore, the interval duration between the individual descaling operations is lengthened again.

As mentioned previously, in the descaling operations carried out at times $t_0$ to $t_6$, a rinsing liquid is used for the descaling of the vapor generator which is recirculated before or simultaneously through the cooking chamber of the cooking appliance. In particular, it can be provided that, in case the degree of scaling of the vapor generator increases above a degree of scaling limit value $V_{G2}$, a special descaling agent be used for the vapor generator as cleaning agent. Due to the high dosage of the descaling agent, thorough cleaning of the steam generator becomes possible. A dosage of the descaling agent is achieved in particular by giving recommendations to the user of the cooking appliance to assign a larger number of individual components of the cleaning agent, specifically in the tablet or tab form, to the cooking chamber for performing the descaling process.

Figure 6:
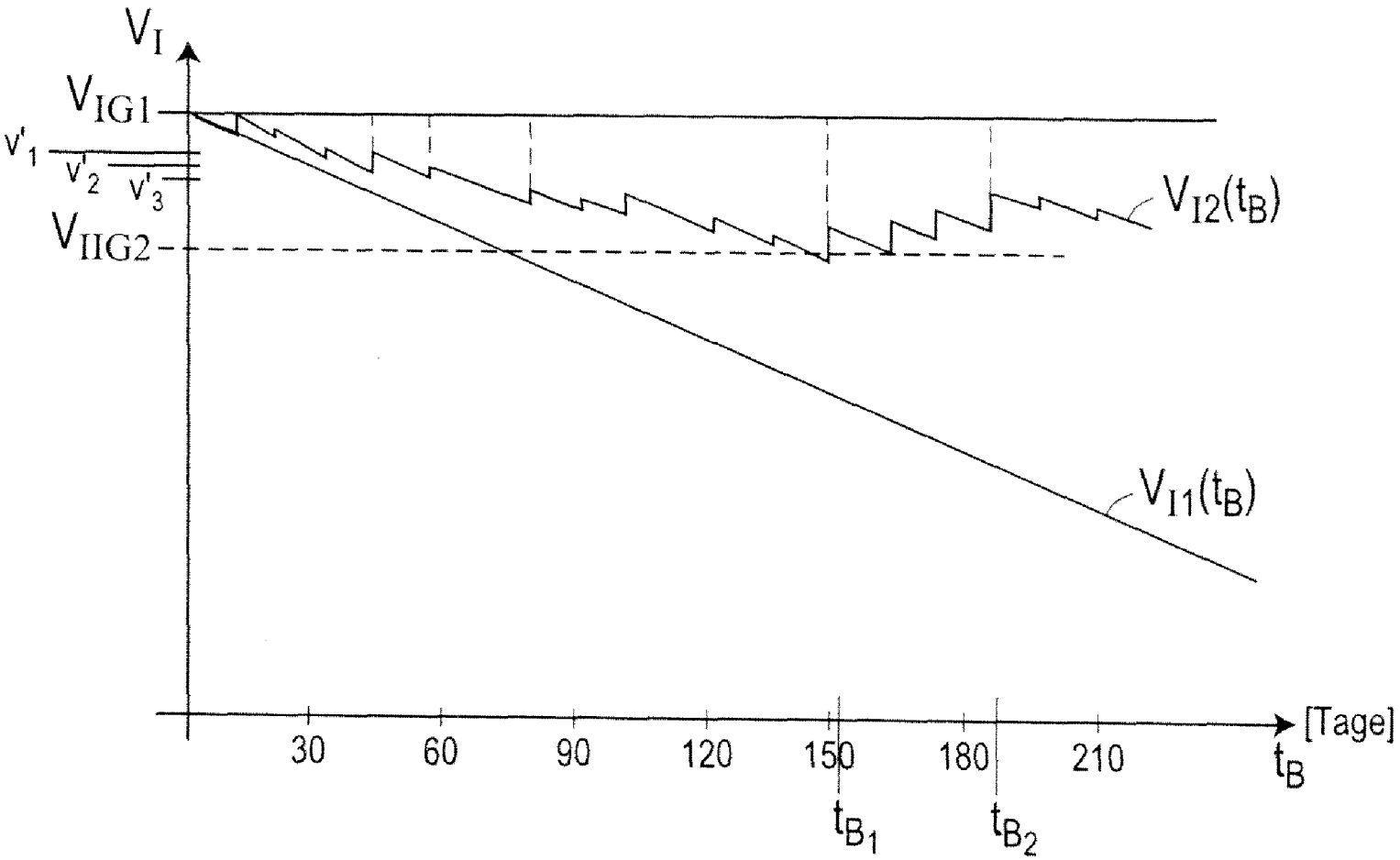
FIG. 6 is a second graphic plot of the inner volume of a fluid-receiving device according to the invention as a function of the time of operation of the fluid-receiving device.

FIG. 6 shows a graphic plot of the inner volume of a fluid-receiving device for various operational runs. The graph $V_{I2}(t_b)$ shows the course of the inner volume of the vapor generator in the case in which no cleaning or descaling of the vapor generator is performed. As can be seen from FIG. 6, the inner volume of the vapor generator decreases continuously. Since the degree of cleaning or scaling of the vapor generator is inversely proportional to the inner volume, the degree of scaling of the vapor generator increases continuously. From the slope of the graph $V_{I2}(t_b)$ or from the first derivative with respect to the operating time $t_b$, the scaling rate is obtained according to the first definition described previously.

Furthermore, in FIG. 6, the course of the inner volume of the vapor generator $V_{II2}(t_b)$ is shown as a function of the operating time $t_B$ of the vapor generator when in predetermined intervals cleaning and/or descaling operations are performed in the vapor generator. Up to an operating time of $t_{B1}$, the descaling operations are conducted, so that the dosages of a descaling agent are adjusted in this example as a function of the inner volumes $V_1'$, $V_2'$, $V_3'$ or to the resulting degrees of scaling. In other words, the adjustment of an action time of the cleaning or descaling agent represents only a subordinate side aspect. In particular, the first degree of contamination $V_{IG1}$ is set equal to an optimum inner volume of the vapor generator, that is, to the inner volume of the steam generator when complete descaling exists. Thus, in the cleaning and descaling operations performed, both an adjustment of the action time of exposure and an adjustment of the dosage of a cleaning agent are effected. If the inner volume of the vapor generator nevertheless drops below a second limiting value $V_{IIG2}$, then a shortening of the time interval, that is, a shortening of the time interval between two subsequent successive descaling operations is effected. This leads again to an increase in the inner volume of the vapor generator or a decrease in the degree of scaling of the vapor generator. Then, starting from an operating time $t_{B2}$, the interval duration is again lengthened, and the dosage of the descaling agent is reduced, and optionally the action time of the descaling agent is shortened. As a result of this, it is achieved that an unnecessarily high consumption of chemicals as well as unnecessarily long interruptions in the operation of the vapor generator are avoided.

The characteristics of the invention disclosed in the above specification, in the drawing as well as in the claims can be essential both individually as well as in any arbitrary combination for the realization of the invention in its various embodiments.

We claim:

1. Method for conducting, at predetermined time intervals, cleaning operations carried out in at least one of an inner chamber and a container of a fluid-receiving device of a foodstuff-processing apparatus, whereby at least one first fluid can be contained in the at least one of the inner chamber and the container, the method comprising:

(a) determining at least one first degree of cleaning at at least one first moment in time of a first cleaning process;

(b) determining at least one second degree of cleaning at at least one second moment in time of at least of one second cleaning operation subsequent to the first cleaning process;

(c) determining a first difference between the first degree of cleaning and the second degree of cleaning;

(d) at least one of determining and adjusting an action duration of a cleaning agent for at least one subsequent cleaning operation as a function of at least one of the first degree of cleaning, the second degree of cleaning, the first difference, and a cleaning speed in a first case, in which at least one of the following occurs:

(i) the second degree of cleaning lies below at least one first degree of cleaning limit value, (ii) the first difference lies below at least one first difference limit value, and (iii) the cleaning speed lies below at least one first speed limit value; and (e) at least one of increasing a dosage of the cleaning agent and shortening a time interval between two subsequent successive cleaning operations in a second case, in which at least one of the following occurs:

(i) the second degree of cleaning lies above the first degree of cleaning limit value, (ii) the first difference lies above the first difference limit value, and (iii) the cleaning speed lies above the first speed limit value.

2. Method according to claim 1, further comprising one of the following:

choosing the beginning of the first cleaning operation as the first moment in time and the beginning of the second cleaning operation as the second moment in time;

choosing the end of the first cleaning operation as the first moment in time and the end of the second cleaning operation as the second moment in time;

choosing the end of the first cleaning operation as the first moment in time and the beginning of the second cleaning operation as the second moment in time; and choosing the beginning of the first cleaning operation as the first moment in time and the end of the second cleaning operation as the second moment in time.

3. Method according to claim 1, wherein determining the action duration of the cleaning agent is performed as a function of at least one of the first degree of cleaning, the second degree of cleaning, the first difference, and of the cleaning speed.

4. Method according to claim 1, further comprising determining the cleaning speed by calculating a time derivative of the degree of cleaning based on the first difference and a time interval between the first and second moment in time.

5. Method according to claim 4, further comprising at least one of:

predetermining at least one of the first time period and the second time period; and determining at least one of the first time period and the second time period as a function of at least one of an amount of fluid, the first difference, the cleaning speed, the first degree of cleaning, and the second degree of cleaning.

6. Method according to claim 1, further comprising:

lengthening the action duration of the cleaning agent for at least one subsequent cleaning operation by at least one first time period in a third case, in which the cleaning speed is positive; and shortening the action duration of the cleaning agent for at least one subsequent cleaning operation by at least one second time period in a fourth case, in which the cleaning speed is negative.

7. Method according to claim 6, further comprising:

(a) increasing the dosage of the cleaning agent for at least one subsequent cleaning operation in a fifth case, in which at least one of the following occurs:

(i) the first degree of cleaning lies below a second difference limit value, (ii) the second degree of cleaning lies below a second difference limit value, and (iii) the cleaning speed lies below a second speed limit value;

(b) shortening the time interval between two subsequent successive cleaning operations in a sixth case, in which at least one of the following occurs:

(i) the first degree of cleaning lies above the degree of cleaning limit value, (ii) the second degree of cleaning lies above the degree of cleaning limit value, (iii) the first difference lies above the second difference limit value, and (iv) the cleaning speed lies above the second speed limit value, (c) lengthening the time interval between two subsequent successive cleaning operations in a seventh case, in which at least one of the following occurs:

(i) the first degree of cleaning of at least one of a first and a second subsequent cleaning operation lies below a second degree of cleaning limit value, (ii) the second degree of cleaning of at least one of a first and second subsequent cleaning operation lies again below the second degree of cleaning limit value, (iii) the first difference in the subsequent first and second cleaning operations lies again below the second difference limit value, and (iv) the cleaning speed lies again below the second speed limit value; and (d) reducing the dosage of the cleaning agent for a subsequent cleaning operations in an eighth case, in which at least one of the following occurs:

(i) the first degree of cleaning of at least one of a first and second subsequent cleaning operation lies again below the first degree of cleaning limit value, (ii) the second degree of cleaning of at least one of a first and a second subsequent cleaning operation lies again below the first degree of cleaning limit value, (iii) the first difference in the subsequent first and second cleaning operations lies again below the first difference limit value, and (iv) the cleaning speed lies again the first speed limit value.

8. Method according to claim 7, wherein the fifth case and the sixth each comprise the second case, the seventh case comprises one of the fifth case and the sixth case, and the eighth case comprises at least one the fifth case and the sixth case.

9. Method according to claim 7, wherein increasing the dosage of the cleaning agent for at least one subsequent cleaning operation in the fifth case comprises increasing the dosage as a function of at least one of the first degree of cleaning, the second degree of cleaning, of the first difference, and the cleaning speed.

10. Method according to claim 7, wherein shortening the time interval between two subsequent successive cleaning operations in a sixth case comprises shortening the time interval as a function of at least one of the first degree of cleaning, the second degree of cleaning, the first difference, and the cleaning speed.

11. Method according to claim 7, wherein lengthening the time interval between two subsequent successive cleaning operations in a seventh case comprises lengthening the time interval as a function of at least one of the first degree of cleaning, the second degree of cleaning, the first difference, and the cleaning speed.

12. Method according to claim 7, wherein reducing the dosage of the cleaning agent for subsequent cleaning operations in an eighth case comprises reducing the dosage as a function of at least one of the first degree of cleaning limit value, the second degree of cleaning, the first difference, and the cleaning speed.

13. Method according to claim 7, further comprising:

(a) shortening a time interval between two subsequent successive cleaning operations in a ninth case, in which at least one of the following occurs:

(i) the first degree of cleaning lies below a third degree of cleaning limit value, (ii) second degree of cleaning lies below a third degree of cleaning limit value, (iii) the first difference lies below a third difference limit value, and (iv) the cleaning speed lies below a third speed limit value;

(b) increasing the dosage of the cleaning agent for at least one subsequent cleaning operation in a tenth case, in which at least one of the following occurs:

(i) at least one of the first and second degree of cleaning lies above the third degree of cleaning limit value, the first difference lies above the third difference limit value and/or the cleaning speed lies above the third speed limit value;

(c) reducing the dosage of the cleaning agent for at least one subsequent cleaning operation in an eleventh case, in which at least one of the following occurs:

(i) the first degree of cleaning of a subsequent second cleaning operation again lies below the third degree of cleaning limit value, (ii) the second degree of cleaning of a subsequent second cleaning operation again lies below the third degree of cleaning limit value, and (iii) the first difference in the subsequent first and second cleaning operations lies again below the third difference limit value and/or the cleaning speed lies again below the third speed limit value; and (d) lengthening the time interval between two subsequent successive cleaning operation in a twelfth case, in which at least one of:

(i) the first degree of cleaning of a at least one of a first and a second subsequent cleaning operation again lies below the first degree of cleaning limit value, (ii) the second degree of cleaning of at least one of a first and a second subsequent cleaning operation again lies below the first degree of cleaning limit value, (iii) the first difference in the subsequent first and second cleaning operations lies again below the first difference limit value, and (iv) the cleaning speed lies again below the first speed limit value.

14. Method according to claim 13, wherein the ninth case and the tenth case each comprises the second case, the eleventh case comprises at least one of the ninth case and the tenth case, and the twelfth case comprises at least one of the ninth case and the tenth case.

15. Method according to claim 13, further comprising:

determining at least one third degree of cleaning at the beginning of at least one third cleaning process, determining at least one fourth degree of cleaning at the end of the third cleaning process, choosing the action duration of the cleaning agent during the third cleaning operation to achieve a maximum cleaning for the selected dosage, and determining the first difference limit value based on at least one second difference between the second and third and the fourth degree of cleaning.

16. Method according to claim 15, wherein the third cleaning operation comprises one of the first and second cleaning processes, and the at least one third degree of cleaning comprises one of the first and second degrees of cleaning.

17. Method according to claim 15, wherein the first difference limit value is set equal to the second difference.

18. Method according to claim 17, further comprising:

determining at least one fifth degree of cleaning at the beginning of at least one fourth cleaning process, and determining at least one sixth degree of cleaning at the end of the fourth cleaning process, selecting the action duration of the cleaning agent during the fourth cleaning operation to maximize dosage of the cleaning agent and achieve maximum cleaning, and determining the second difference value based on at least one third difference between the fifth and sixth degree of cleaning.

19. Method according to claim 18, wherein the at least one fourth cleaning operation comprises one of the first and second cleaning processes.

20. Method according to claim 18, wherein the fifth degree of cleaning comprises one of the first and second degrees of cleaning.

21. Method according to claim 18, wherein the second difference limit value is set equal to the third difference.

22. Method according to claim 18, further comprising:

determining a seventh degree of cleaning at the beginning of at least one fifth cleaning process, determining at least one eighth degree of cleaning at the end of the fifth cleaning process, choosing the action duration of the cleaning agent during the fifth cleaning operation to maximize cleaning for a minimum time interval between two cleaning operations and at the selected dosage of the cleaning agent, and determining the third difference limit value based on at least one fourth difference between the seventh and the eighth degree of cleaning.

23. Method according to claim 22, wherein the at least one fifth cleaning operation comprises one of the first and second cleaning processes.

24. Method according to claim 22, wherein the seventh degree of cleaning comprises one of the first and second degrees of cleaning.

25. Method according to claim 22, wherein the third difference limit value is set equal to the fourth difference.

26. Method according to claim 22, further comprising:

determining at least one ninth degree of cleaning at the end of at least one sixth cleaning process, determining at least one tenth degree of cleaning at the beginning of at least one seventh cleaning process, following the sixth cleaning process, and determining at least one eleventh degree of cleaning at the end of the seventh cleaning process, and determining at least one fifth difference between the ninth and the tenth degree of cleaning and at least one sixth difference between the tenth and eleventh degree of cleaning.

27. Method according to claim 26, wherein the sixth cleaning operation comprises the first cleaning process.

28. Method according to claim 26, wherein the seventh cleaning operation comprises the second cleaning process.

29. Method according to claim 26, further comprising:

(a) determining at least one first interval duration by one of:

(i) multiplying the time interval between the sixth and seventh cleaning operations by the sixth difference and dividing the time interval between the sixth and seventh cleaning operations by the fifth difference, and (ii) dividing the sixth difference by the cleaning speed.

30. Method according to claim 29, further comprising at least one of:

shortening the time interval between two subsequent successive cleaning processes by at least one second interval duration to the first interval duration, and lengthening the time interval between two subsequent successive cleaning processes by at least one third interval duration to the first interval duration.

31. Method according to claim 30, wherein shortening the time interval occurs in at least one of the sixth case and the ninth case.

32. Method according to claim 30, wherein lengthening the time interval occurs in at least one of the seventh case and the eighth case.

33. Method according to claim 30, wherein at least one of the first time interval, the second time interval, the first interval duration, the second interval duration, and the third interval duration is one of determined and predetermined as a function of at least one of:

the first difference, the second difference, the third difference, the fourth difference, the fifth difference, the sixth difference, the first degree of cleaning, the second degree of cleaning, the third degree of cleaning, the fourth degree of cleaning, the fifth degree of cleaning, the sixth degree of cleaning, the seventh degree of cleaning, the eighth degree of cleaning, the ninth degree of cleaning, the tenth degree of cleaning, the eleventh degree of cleaning, and the cleaning speed.

34. Method according to claim 30, further comprising:

determining the anticipated moment in time of at least one subsequent cleaning operation based on at least one of the first interval duration, the second interval duration, and the third interval duration.

35. Method according to claim 34, wherein determining the anticipated moment in time comprises determining the anticipated moment in time as a function of the time elapsed since the last cleaning process.

36. Method according to claim 35, further comprising:

determining at least one of the time interval between two cleaning processes, the first moment in time, the second moment in time, the first time period, the second time period, the time interval between the first and the second moment in time, the first interval duration, the second interval duration, the third interval duration, and the time elapsed since the last cleaning operation based on at least one operating time of at least one of a foodstuff-processing apparatus comprising the fluid-receiving device and of the fluid-receiving device.

37. Method according to claim 36, further comprising:

wherein the time interval between two cleaning processes, the first moment in time, the second moment in time, the first time period, the second time period, the time interval between the first and the second moment in time, the first interval duration, the second interval duration, the third interval duration, and the time elapsed since the last cleaning operation is proportional to at least one operating time of at least one of a foodstuff-processing apparatus comprising the fluid-receiving device and of the fluid-receiving device.

38. Method according to claim 34, further comprising outputting the anticipated moment in time.

39. Method according to claim 34, wherein determining the anticipated moment in time comprises determining the anticipated moment in time by subtracting of the elapsed time from the first interval duration.

40. Method according to claim 13, further comprising at least one of:

(a) shortening the time interval between two cleaning processes;

(b) increasing the dosage of the cleaning agent; and (c) performing at least one of the following:

(i) lengthening of the time interval between two cleaning operations and decreasing the dosage of the cleaning agent, (ii) lengthening of the time interval between two cleaning operations and increasing the dosage of the cleaning agent, and (iii) shortening of the time interval between two cleaning operations and decreasing the dosage of the cleaning agent, when at least one of the following occurs:

(d) the second difference limit value to be approximately equal to the third difference limit value, (e) the second degree of cleaning limit value to be approximately equal to the third degree of cleaning limit value, and (f) the second speed limit value to be equal to the third speed limit value.

41. Method according to claim 1, wherein
the cleaning agent is formed from at least:
a cleaning agent component, further comprising altering at least one of the concentration and the amount of the at least one cleaning component in order to change the dosage of the cleaning agent.

42. Method according to claim 1, further comprising:
changing the dosing of the cleaning agent for at least one subsequent cleaning operation by at least one adjustment value, and
determining the adjustment value based on a deviation of an actual dosage of the cleaning agent from a target dosage in at least one previously-performed cleaning process.

43. Method according to claim 42, further comprising:
introducing the cleaning agent at least partially manually, wherein introducing the cleaning agent at least partially manually comprises introducing the cleaning agent as a function of at least one outputted dosage recommendation for at least one of the cleaning agent and one cleaning agent component.

44. Method according to claim 43, further comprising:
(a) circulating a cleaning agent which is used before and/or simultaneously for the cleaning of another component of the foodstuff-processing apparatus in a thirteenth case, in which at least one of the following occurs:
(i) the first degree of cleaning lie below a fourth degree of cleaning limit value,
(ii) the second degree of cleaning lie below a fourth degree of cleaning limit value,
(iii) the cleaning speed lies below a fourth speed limit value, and
(iv) the first difference lies below a fourth difference limit value, and
(b) circulating a cleaning agent, which first serves essentially exclusively for the cleaning of the fluid-receiving device, in a subsequent operation in a fourteenth case, in which at least one of the following occurs:
(i) the first degree of cleaning lie above the fourth degree of cleaning limit value,
(ii) the second degree of cleaning lie above the fourth degree of cleaning limit value,
(iii) the first difference lies above the fourth cleaning limit value, and
(iv) the cleaning speed lies above the fourth speed limit value.

45. Method according to claim 44, wherein at least one of the following holds true:
at least one degree of cleaning comprises at least one degree of soiling, at least one degree of contamination, at least one degree of scale deposition and/or at least one degree of corrosion,
at least one degree of cleaning limit value comprises at least one soiling limit value, at least one contamination limit value, at least one scale deposition limit value and/or at least one corrosion limit value, and
at least one cleaning speed comprises at least one soiling speed, at least one contamination speed, at least one scale deposition speed and/or at least one corrosion speed.

46. Method according to claim 45, wherein
the at least one degree of cleaning is determined by determination of an inner volume change of at least one of the inner chamber and container of the fluid-receiving device, by at least one of the following:
(a) determining at least one temperature change rate of the first fluid in the at least one of the inner chamber and container of the fluid-receiving device,
(b) determining at least one surface temperature of at least one heating device of the fluid-receiving device, and
(c) determining at least one third and at least one fourth moment in time at which one fluid introduced into the at least one of the inner chamber and container comes into working connection with at least one first or second sensor.

47. Method according to claim 46, further comprising at least one of:
(a) determining at least one level of the first fluid that can be introduced into the at least one of the inner chamber and container after at least one first filling of the at least one inner chamber and container with a first predetermined amount of the first fluid,
(b) determining at least one second amount of the first fluid that is necessary in order to reach at least a second predetermined level of the first fluid in the at least one inner chamber and container during the first filling,
(c) determining at least one third level of the first fluid in the at least one inner chamber and container after at least one second filling of the at least one inner chamber and container that is at least occasionally displaced in time with respect to the first filling, with a third predetermined amount of the first fluid,
(d) determining at least one fourth amount of the first fluid that is necessary in order to reach at least a fourth predetermined level of the first fluid in the at least one inner chamber and container during the second filling, and
(e) determining at least one of the following:
(i) at least one first change of at least two levels of the first fluid between the first and second filling,
(ii) at least one second change of at least two amounts of the first fluid that are necessary for reaching at least one predetermined level of the first fluid in the inner chamber and/or container, between the first and second filling, and
(iii) at least of one third change of at least one first relation formed from at least one level of the first fluid and at least one amount of the first fluid necessary to reach a predetermined level and at least one second relation formed of at least one other level and at least one other amount of the first fluid necessary to reach a predetermined level.

48. Method according to claim 47, further comprising:
using at least one of the first change, the second change, and the third change to determine at least one of the following:
at least one degree of cleaning,
at least one cleaning speed, and
at least one characteristic quantity of the first fluid.

49. Method according to claim 48, further comprising:
comparing at least one of the cleaning speed, the characteristic quantity, the first change, the second change, and the third change with at least one comparison value in order to determine the degree of cleaning.

50. Method according to claim 48, wherein
the characteristic quantity of the first fluid is determined based on at least one of the following: the first degree of cleaning, the second degree of cleaning, the third degree of cleaning, the fourth degree of cleaning, the fifth degree of cleaning, the sixth degree of cleaning, the seventh degree of cleaning, the eighth degree of cleaning, the ninth degree of cleaning, the tenth degree of cleaning, the eleventh degree of cleaning, at least one additional degree of deposition on at least one wall of the at least one of the inner chamber and container, and at least one first substance.

51. Method according to claim 50, wherein the at least one first substance comprises at least one of a substance present in the first fluid and a substance dissolved in the first fluid.

52. Method according to claim 48, further comprising at least one of the following:

determining the characteristic quantity of the first fluid as at least one concentration of at least one second substance in the first fluid, and determining at least one degree of hardness of the first fluid.

53. Method according to claim 52, wherein the characteristic quantity of the first fluid is determined as at least one concentration of ions present in the first fluid.

54. Method according to claim 52, wherein the compound comprises lime, and the at least one second substance leads to at least one of:

the deposition of the first substance, and the formation of a contaminant, a soiling, and a corrosion.

55. Method according to claim 54, wherein the contaminant comprises a scale deposit.

56. Method according to claim 54, wherein the second substance is at least partially identical to the first substance.

57. Method according to claim 48, further comprising:

making at least one dosage instruction for at least one third substance to be combined with the first fluid depending on the characteristic quantity of the first fluid.

58. Method according to claim 57, wherein the dosage instruction is determined for at least one of the following:

the cleaning agent, and at least one cleaning agent component.

59. Method according to claim 58, further comprising at least one of the following:

mixing at least one of the third substance, the cleaning agent, and the cleaning agent component with the first fluid, and issuing at least one instruction to at least one user for adding at least one of the third substance, the cleaning agents, and the at least one cleaning agent component.

60. Method according to claim 59, wherein the mixing is conducted with the aid of at least one dosage device.

61. Method according to claim 59, wherein mixing comprises dissolving at least one of the third substance, the cleaning agent, and the cleaning agent component in the first fluid.

62. Method according to claim 59, wherein the instruction comprises recommending to add at least one of the third substance, the cleaning agents, and the at least one cleaning agent component to the at least one of the inner chamber and container.

63. Method according to claim 57, further comprising:

combining at least one of the third substance, the cleaning agent, and at least one cleaning agent component with the first fluid as a function of the established interval between the cleaning processes.

64. Method according to claim 63, wherein at least one element of the first fluid is introduced into a foodstuff-processing apparatus that is in working connection with at least one of a food processing device and a fluid-receiving device.

65. Method according to claim 64, wherein the at least one element of the first fluid is introduced into the at least one of the inner chamber and container of at least one of: a vapor generator, a quenching box, and a cooking chamber, in order to perform a cleaning operation in the fluid-receiving device.

66. Method according to claim 63, further comprising:

combining a third substance and at least one of a cleaning agent and a cleaning agent component, and at least one second fluid with the first fluid.

67. Method according to claim 63, wherein the third substance is dissolved in the first fluid.

68. Method according to claim 63, further comprising:

achieving a change in the concentration of the second substance in the first fluid with the third substance and at least one of the cleaning agent and a cleaning agent component, and forming at least one detergent substance with the third substance and at least one of the cleaning agent and a cleaning agent component.

69. Method according to claim 47, wherein at least one of:

the first change is determined by determining a seventh difference between the first and third level of the first fluid, the second change is determined by determining an eighth difference between the second and the fourth amount of the first fluid, the first relation of the first level and the second amount of the first fluid is formed, and the second relation of the third level and the fourth amount of the first fluid is formed.

70. Method according to claim 69, wherein at least one of:

a quotient of the first level and the second amount of the first fluid is formed, and a quotient of the third level and the fourth amount of the first fluid is formed.

71. Method according to claim 69, wherein at least one of:

the first amount and the third amount of the first fluid are the same, and the second level and the fourth level of the first fluid are the same.

72. Method according to one of claim 47, further comprising:

producing at least one alarm when the level of the fluid exceeds a predetermined value in the at least one of the inner chamber and container.

73. Method according to claim 72, further comprising:

(a) determining a third moment in time at which a fluid enters into interaction with at least one of:

(i) a first contactless sensor arranged outside on a wall of the at least one of the inner chamber and container, and (ii) a first contactless sensor arranged outside on an feed pipe to the at least one of the inner chamber and container, concerning a change of a first output signal of the at least one first sensor;

(b) determining a fourth moment in time at which the fluid enters into interaction with at least one of:

(i) a second contactless sensor applied outside on a wall of the at least one of the inner chamber and container, through a change of a second output signal of the at least one second sensor, whereby upon filling the at least one of the inner chamber and container the fluid first comes into interaction with the at least one first sensor and then comes into interaction with the at least one second sensor, so that the fourth moment in time occurs temporally after the third moment in time; and (c) determining a degree of cleaning as a function of the third moment in time and the fourth moment in time.

74. Method according to claim 73, wherein determining a degree of cleaning as a function of the third moment in time and the fourth moment in time comprises evaluating a first time difference between the third moment in time and the fourth moment in time.

75. Method according to claim 74, wherein determining a degree of cleaning as a function of the third moment in time and the fourth moment in time comprises considering a fluid pressure in a line used for filling the at least one of the inner chamber and container with the fluid.

76. Method according to claim 75, wherein considering the fluid pressure comprises measuring a second time difference between the third moment in time and the fourth moment in time in the case where the at least one of the inner chamber and container has substantially no contaminant.

77. Method according to claim 73, wherein determining a degree of cleaning as a function of the third moment in time and the fourth moment in time comprises comparing at least one of the third and fourth moments in time with at least one corresponding value that is detected in a filling operation of the at least one of the inner chamber and container substantially without a contamination such as at least one of scale deposit, soiling, and corrosion.

78. Method according to claim 73, wherein determining a degree of cleaning as a function of the third moment in time and the fourth moment in time comprises determining a property of the contaminant at least in the region of at least one of the first and second sensors.

79. Method according to claim 73, further comprising:

filling the at least one of the inner chamber and container with fluid up to the fourth moment in time.

80. Method according to claim 79, further comprising at least one of storing at least one parameter on a memory device and recalling at least one parameter from a storage device, wherein the parameter comprises at least one of:

the first level, the second level, the third level, the fourth level, the first degree of cleaning, the second degree of cleaning, the third degree of cleaning, the fourth degree of cleaning, the fifth degree of cleaning, the sixth degree of cleaning, the seventh degree of cleaning, the eighth degree of cleaning, the ninth degree of cleaning, the tenth degree of cleaning, the eleventh degree of cleaning, the first difference, the second difference, the third difference, the fourth difference, the fifth difference, the sixth difference, the seventh difference, the eighth difference, the first degree of cleaning limit value, the second degree of cleaning limit value, the third degree of cleaning limit value, the fourth degree of cleaning limit value, the first speed limit value, the second speed limit value, the third speed limit value, the fourth speed limit value, the first difference limit value, the second difference limit value, the third difference limit value, the fourth difference limit value, the action duration, the dosage of the cleaning agent, the time interval between two cleaning processes, the first moment in time, the second moment in time, the third moment in time, the fourth moment in time, the first time period, the second time period, the first interval duration, the second interval duration, the third interval duration, the adjustment value, the first time difference, the second time difference, a filling level at the fourth moment in time, the first amount of fluid, the second amount of fluid, the third amount of fluid, the fourth amount of the fluid, the first change, the second change, the third change, the first ratio, the second ratio, the comparison value, at least one quotient, the characteristic quantity, the at least one dosage recommendation, and the alarm.

81. Method according to claim 80, wherein the characteristic quantity comprises a degree of hardness of the first fluid.

82. Method according to claim 1, further comprising:

(a) at least one of:

(i) choosing the first cleaning limit value to be equal to a minimum degree of cleaning, (ii) choosing the first difference limit value to be equal to zero; and (b) performing an adaptation of at least one of the following:

(i) the action duration and the time interval between two subsequent successive cleaning processes, (ii) the action duration, the dosage of the cleaning agent, and the time interval between two subsequent successive cleaning processes, and (iii) the dosage of at least one of the cleaning agent and the time interval between two subsequent successive cleaning processes.

83. Method according to claim 82, wherein the first cleaning limit value is chosen to correspond to a completely cleaned fluid-receiving device.

84. Method according to claim 82, wherein the first difference limit value is chosen as an adaptation of the action duration as well as the dosage of the cleaning agent.

85. Method according to claim 82, wherein performing the adaptation occurs while maintaining a preferably previously-determined action duration of the cleaning agent.

* * * * *